US010752027B2

(12) United States Patent
Takeda et al.

(10) Patent No.: US 10,752,027 B2
(45) Date of Patent: Aug. 25, 2020

(54) MEDIUM TRANSPORTING DEVICE AND RECORDING APPARATUS

(71) Applicant: SEIKO EPSON CORPORATION, Tokyo (JP)

(72) Inventors: Kazuhisa Takeda, Shiojiri (JP); Kazuo Otsuka, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/839,658

(22) Filed: Apr. 3, 2020

(65) Prior Publication Data

US 2020/0230978 A1 Jul. 23, 2020

Related U.S. Application Data

(63) Continuation of application No. 16/173,095, filed on Oct. 29, 2018, now Pat. No. 10,647,133.

(30) Foreign Application Priority Data

Oct. 31, 2017 (JP) ..... 2017-210014
Jun. 11, 2018 (JP) ..... 2018-111237

(51) Int. Cl.
*B65H 1/04* (2006.01)
*B41J 11/00* (2006.01)
(Continued)

(52) U.S. Cl.
CPC ..... *B41J 11/06* (2013.01); *B41J 2/04501* (2013.01); *B41J 11/0025* (2013.01);
(Continued)

(58) Field of Classification Search
CPC ..... B41J 2/17523; B41J 2/17506; B41J 2/17553; B41J 2/175; B41J 2/165;
(Continued)

(56) References Cited

U.S. PATENT DOCUMENTS 7,469,981 B2 * 12/2008 Katsuyama ..... B41J 2/17509 347/1
9,481,180 B2 * 11/2016 Kimura ..... B41J 2/17523
(Continued)

FOREIGN PATENT DOCUMENTS

JP 2004-223831 8/2004
JP 2016-155666 9/2016
JP 6138612 B2 5/2017

*Primary Examiner* — Thinh H Nguyen
(74) *Attorney, Agent, or Firm* — Workman Nydegger

(57) ABSTRACT

A medium transporting device provided in a printer includes a curved path in which a paper sheet after recording is curved and inverted, a plurality of first ribs that extend in a medium transportation direction in a facing area facing a recording head, that are provided at intervals in a width direction intersecting the medium transportation direction, and that form cockling on the paper sheet, a plurality of second ribs that are provided on an outer curved portion of the curved path, and a plurality of third ribs that are provided on an inner curved portion of the curved path. The plurality of second ribs and the plurality of third ribs are disposed at positions in the width direction that correspond to a mountain portion and a valley portion of the cockling of the paper sheet that is formed by the plurality of first ribs.

18 Claims, 26 Drawing Sheets

(51) Int. Cl.
*B65H 5/38* (2006.01)
*B41J 2/045* (2006.01)
*B41J 11/06* (2006.01)

(52) U.S. Cl.
CPC ..... *B41J 11/0045* (2013.01); *B65H 1/04* (2013.01); *B65H 5/38* (2013.01); *B65H 2402/441* (2013.01); *B65H 2404/513* (2013.01); *B65H 2404/6111* (2013.01); *B65H 2405/324* (2013.01); *B65H 2405/3322* (2013.01); *B65H 2407/21* (2013.01)

(58) Field of Classification Search
CPC ..... B41J 11/06; B41J 11/0025; B41J 11/0045; B65H 1/04; B65H 5/38; B65H 2402/441; B65H 2404/513; B65H 2404/6111; B65H 2405/324; B65H 2405/3322; B65H 2407/21
See application file for complete search history.

(56) References Cited

U.S. PATENT DOCUMENTS

| | | | |
|---|---|---|---|
| 2010/0238250 | A1 | 9/2010 | Kachi |
| 2018/0345688 | A1 | 12/2018 | Shomura |

* cited by examiner

MEDIUM TRANSPORTING DEVICE AND RECORDING APPARATUS

BACKGROUND

1. Technical Field

The present invention relates to a medium transporting device that transports a medium and a recording apparatus that performs recording on a medium transported by the medium transporting device.

2. Related Art

In a recording apparatus represented by an ink jet printer that ejects liquid onto a medium to perform recording, a medium after the recording may absorb the liquid so that cockling, which is a wave-like shape extending in a width direction intersecting a medium transportation direction, may be formed on the medium.

In addition, there is a case where a wave shape forming part that actively forms the cockling on a medium before recording performed by a recording unit is provided in order to stabilize the posture of the medium on a medium supporting portion (also referred to as platen) which is provided at a position that faces the recording unit performing the recording on the medium.

The rigidity of the medium on which the cockling is formed is increased so that the posture of the medium on the medium supporting portion is stabilized.

Meanwhile, in the recording apparatus, the medium after the recording may be discharged by a so-called face-up discharging method, in which the medium is discharged through a linearly formed path with a recording surface facing an upper side, or may be discharged by a so-called face-down discharging method, in which the medium is discharged through a curved inversion path with the recording surface facing a lower side.

In a case where the medium is transported through the inversion path, it is difficult for the medium, on which the cockling is formed and of which the rigidity is increased, to be transported along a curved portion of the inversion path and thus there is a high possibility of an increase in transportation load. In addition, the medium on which the cockling is formed is likely to be caught in a curved path and thus there is a possibility of a paper jam.

In order to suppress the above-described problems, JP-A-2004-223831 discloses a configuration in which a bending roller that bends a medium in the vicinity of an inlet of an inversion path is provided. Since the position of the origin of the bending of the medium entering the inversion path is changed due to the bending roller, the transportation load in the inversion path is decreased. The transportation load is referred to as front tension in JP-A-2004-223831 and is a force that pushes back the medium toward an upstream side from a downstream side.

However, in the case of the configuration disclosed in JP-A-2004-223831, since the medium is suddenly bent in the vicinity of the inlet of the inversion path, there may be damage to the medium such as a wrinkle, a fold, or a scratch.

In addition, when the medium is gently bent on the upstream side of the inversion path in the medium transportation direction, a path on the upstream side of the inversion path becomes long and the device becomes large although the damage to the medium is decreased.

In addition, even when a removing unit that removes the cockling is provided on the upstream side of the inversion path, since the removing unit comes into contact with the recording surface at a place close to a recording position, there is a possibility of transfer of ink to the recording surface and when the removing unit is provided at a place distant from the recording position to avoid the above-described problem, there is a problem that the device becomes large since the inversion path needs to be formed to extend from the position of the removing unit.

SUMMARY

An advantage of some aspects of the invention is to provide a medium transporting device that has been designed in consideration of both of a decrease in transportation load and damage to a medium transported through an inversion path after recording and suppression of an increase in size of the device and a recording apparatus provided with the medium transporting device.

According to an aspect of the invention, there is provided a medium transporting device including: a curved path in which a medium subjected to processing in a processing unit is curved and inverted while passing through a space between an inner curved portion and an outer curved portion, the processing unit performing the processing on the medium; a plurality of first ribs that extend in a medium transportation direction in a facing area facing the processing unit or on the upstream side of the facing area in the medium transportation direction, that are provided at intervals in a width direction intersecting the medium transportation direction, and that form a wave-like shape on the medium, the wave-like shape being formed by a mountain portion and a valley portion extending in the medium transportation direction and alternately positioned in the width direction; a plurality of second ribs that extend in the medium transportation direction on the outer curved portion and are provided at intervals in the width direction; and a plurality of third ribs that extend in the medium transportation direction on the inner curved portion and are provided at intervals in the width direction, in which the plurality of second ribs and the plurality of third ribs are disposed at positions in the width direction that correspond to the mountain portion and the valley portion of the wave-like shape of the medium that is formed by the plurality of first ribs.

In this case, due to the plurality of second ribs and the plurality of third ribs that are disposed at positions in the width direction that correspond to the mountain portion and the valley portion of the wave-like shape of the medium that is formed by the plurality of first ribs, the wave-like shape gently becomes lower and the rigidity of the medium decreases. Note that, details of the above-described phenomenon, that is, a principle by which the wave-like shape gently becomes lower will be described later.

Accordingly, transportation resistance and damage to the paper medium (wrinkle, fold, or like) that are made when the medium on which the wave-like shape is formed is transported through the curved path can be decreased. Furthermore, due to the second ribs or the third ribs, transportation resistance at the time of transportation of the medium is also suppressed.

In addition, because the plurality of second ribs and the plurality of third ribs are provided in the curved path, a configuration in which the wave-like shape becomes lower can be provided without an increase in path length.

In addition, since the medium is transported while a surface that is opposite to the latest recording surface is pressed against the outer curved portion (that is, second ribs)

and the wave-like shape becomes lower in this process, the latest recording surface is less likely to be damaged.

Therefore, it is possible to provide a medium transporting device that has been designed in consideration of both of a decrease in transportation load and damage to the medium transported through the curved path and suppression of an increase in size of the device.

In the medium transporting device, the plurality of first ribs may include a high rib forming the mountain portion and a low rib forming the valley portion, the high rib and the low rib being alternately arranged in the width direction, and the plurality of second ribs and the plurality of third ribs may be provided at positions corresponding to the high rib and the low rib in the width direction.

In this case, since the plurality of second ribs and the plurality of third ribs are provided at positions corresponding to the high rib and the low rib in the width direction, the plurality of second ribs and the plurality of third ribs can be disposed at positions in the width direction that correspond to the mountain portion and the valley portion of the wave-like shape of the medium that is formed by the plurality of first ribs.

Note that, the expression "the plurality of second ribs and the plurality of third ribs are provided at positions corresponding to the high rib and the low rib in the width direction" may be interpreted as "the plurality of second ribs and the plurality of third ribs are provided at the same positions as the high rib and the low rib in the width direction". Here, "the same positions" may mean the substantially same positions and the plurality of second ribs and the plurality of third ribs do not need to be provided at the completely same positions as the high ribs and the low ribs in the width direction in the strict sense. For example, positions different from each other within the range of tolerance can be regarded as the same positions.

In the medium transporting device, an interval between a top point of the second rib and a top point of the third rib facing the second rib may become narrower toward the downstream side from the upstream side in the medium transportation direction.

In this case, since the interval between the top point of the second rib and the top point of the third rib facing the second rib becomes narrower toward the downstream side from the upstream side in the medium transportation direction, a configuration in which an inlet of the curved path through which the medium enters the curved path is wide and the medium on which the wave-like shape is formed easily enters the curved path can be realized. In addition, since a gap (gap between top point of second rib and top point of third rib facing second rib) through which the medium is fed becomes narrower as the medium is transported, the difference in height between the mountain portion and the valley portion of the wave-like shape can be gradually decreased.

The medium transporting device may further include an upstream side transportation part that is provided on the upstream side of the curved path in the medium transportation direction and transports the medium to the curved path, and a downstream side transportation part that is provided on the downstream side of the curved path in the medium transportation direction and discharges the medium from the curved path.

In this case, it is possible to achieve the same effect as above with the medium transporting device including the upstream side transportation part that is provided on the upstream side of the curved path in the medium transportation direction and transports the medium to the curved path and the downstream side transportation part that is provided on the downstream side of the curved path in the medium transportation direction and discharges the medium from the curved path.

The medium transporting device may further include a supporting portion that supports the medium at a position on the downstream side of the upstream side transportation part in the medium transportation direction and that is able to be displaced between a first state in which a path from the upstream side transportation part to the curved path is formed and a second state in which a path from the upstream side transportation part to a transportation destination different from the curved path is formed and the supporting portion may include a plurality of fourth ribs that extend in the medium transportation direction and are provided at the same intervals as the second ribs in the width direction.

In this case, the supporting portion is provided with the plurality of fourth ribs that extend in the medium transportation direction and are provided at the same intervals as the second ribs in the width direction, the medium can be appropriately fed to the curved path.

In the medium transporting device, at least some of the plurality of fourth ribs may be provided with a protruding portion that is provided on a downstream side end portion in the medium transportation direction and protrudes upward in a side view as seen in the width direction.

When the heights of the fourth ribs provided on the supporting portion and the heights of the second ribs provided on the outer curved portion that is positioned on the downstream side of the fourth ribs in the medium transportation direction are set to be the same as each other, the heights of the fourth ribs and the second ribs may be different from each other at a joint between the supporting portion and the outer curved portion due to the tolerance of the members in a case where the supporting portion and the outer curved portion of the curved path are lined up. In this case, when the second ribs, which are positioned on the downstream side in the medium transportation direction, are higher than the fourth ribs, the leading end of the transported medium may be caught on the second ribs.

In this case, since at least some of the plurality of fourth ribs is provided with the protruding portion that is provided on the downstream side end portion in the medium transportation direction and protrudes upward in a side view as seen in the width direction, even if there is a variation between the heights of the second ribs and the fourth ribs due to the tolerance of the members, at least some of the fourth ribs can be reliably higher than the second ribs at the joint. Therefore, it is possible to reduce a possibility that the leading end of the medium is caught on the second ribs at the joint.

In the medium transporting device, the second ribs may include an upstream side second rib and a downstream side second rib of which an upstream side end portion in the medium transportation direction is positioned closer to the downstream side than that of the upstream side second rib, the upstream side second rib and the downstream side second rib being alternately arranged in the width direction, the fourth ribs may include an upstream side fourth rib that is provided at a position corresponding to the upstream side second rib in the width direction, a downstream side fourth rib of which an upstream side end portion in the medium transportation direction is positioned closer to the downstream side than that of the upstream side fourth rib and which is provided at a position corresponding to the downstream side second rib in the width direction, and an auxiliary rib that is provided on at least one side in the width direction with respect to the upstream side fourth rib, the upstream side second rib may partially overlap both of the downstream side fourth rib and the auxiliary rib in the medium transportation direction in a case where the supporting portion is in the first state, and the protruding portion may be provided on each of the downstream side fourth rib and the auxiliary rib.

In this case, the second ribs include the upstream side second rib and the downstream side second rib of which the upstream side end portion in the medium transportation direction is positioned closer to the downstream side than that of the upstream side second rib, the upstream side second rib and the downstream side second rib being alternately arranged in the width direction, the fourth ribs include the upstream side fourth rib that is provided at a position corresponding to the upstream side second rib in the width direction, the downstream side fourth rib of which the upstream side end portion in the medium transportation direction is positioned closer to the downstream side than that of the upstream side fourth rib and which is provided at a position corresponding to the downstream side second rib in the width direction, and the auxiliary rib that is provided on at least one side in the width direction with respect to the upstream side fourth rib, and the upstream side second rib partially overlaps both of the downstream side fourth rib and the auxiliary rib in the medium transportation direction in a case where the supporting portion is in the first state. Therefore, in a case where the supporting portion is in the first state, the second ribs and the fourth ribs mesh with each other in a shape like teeth of a comb so that the transported medium can smoothly pass through the joint between the supporting portion and the outer curved portion.

In addition, since the protruding portion is provided on each of the downstream side fourth rib and the auxiliary rib, it is possible to further effectively suppress the medium being caught in the joint between the outer curved portion and the supporting portion.

The medium transporting device may further include a first transportation part that is provided between the processing unit and the upstream side transportation part and transports the medium.

In this case, it is possible to achieve the same effect as above with the medium transporting device including the first transportation part that is provided between the processing unit and the upstream side transportation part and transports the medium.

In the medium transporting device, the upstream side transportation part may be a pair of upstream side rollers including an upstream side driving roller and an upstream side serrated roller that rotates in accordance with rotation of the upstream side driving roller and has a plurality of teeth on an outer circumference thereof, the first transportation part may be a pair of first rollers including a first driving roller and a first serrated roller that rotates in accordance with rotation of the first driving roller and has a plurality of teeth on an outer circumference thereof, and a diameter of the upstream side serrated roller may be smaller than a diameter of the first serrated roller.

In this case, since the diameter of the upstream side serrated roller of the upstream side transportation part is smaller than the diameter of the first serrated roller of the first transportation part, it is possible to effectively utilize a space around the first transportation part.

In the medium transporting device, a plurality of the pairs of upstream side rollers may be provided at intervals in the width direction, a plurality of the pairs of first rollers may be provided at intervals in the width direction, and the number of the pairs of upstream side rollers may be smaller than the number of the pairs of first rollers.

In this case, since the number of the pairs of upstream side rollers is smaller than the number of the pairs of first rollers, it is possible to reduce the manufacturing cost for the device.

In the medium transporting device, a transportation speed of the first transportation part and a transportation speed of the upstream side transportation part may be the same as each other.

In this case, it is possible to appropriately transport the medium.

Note that, "the same speed" in the specification may mean the substantially same speed and the transportation speeds do not need to be completely the same speed as each other in the strict sense. For example, the meaning of "the transportation speeds are the same speed each other" includes a case where the transportation speeds can be regarded as being the same speed as each other when considering transportation error or the like that is caused due to the roller diameter of each transportation roller, the eccentricity of a rotary shaft, or the like in addition to a case where the transportation speeds are completely the same as each other.

In the medium transporting device, a transportation speed of the downstream side transportation part may be higher than a transportation speed of the upstream side transportation part.

In this case, it is possible to reduce a possibility that the medium is loosened and jammed in the curved path.

In the medium transporting device, a speed increase rate of the transportation speed of the downstream side transportation part with respect to the transportation speed of the upstream side transportation part may be 1% to 3%.

When the transportation speed of the downstream side transportation part is higher than the transportation speed of the upstream side transportation part in a case where the medium is nipped by both of the upstream side transportation part and the downstream side transportation part, the medium becomes closer to the inner curved portion side as the transportation progresses since a leading end side of the medium is pulled. If the transportation speed of the downstream side transportation part is excessively high, there is an increase in transportation load because the medium is pressed against the inner curved portion before a following end of the medium nipped by the upstream side transportation part is released.

In this case, since the speed increase rate of the transportation speed of the downstream side transportation part with respect to the transportation speed of the upstream side transportation part is 1% to 3%, it is possible to reduce a possibility that the medium comes into contact with the inner curved portion of the curved path and it is possible to more appropriately transport the medium.

According to another aspect of the invention, there is provided a recording apparatus including a recording unit that is a processing unit performing processing on a medium and performs recording by ejecting liquid on the medium and the medium transporting device according to the above-described aspect.

In this case, it is possible to achieve the same effect as the above-described aspect with the medium transporting device that is provided in the recording apparatus including the recording unit that is the processing unit performing processing on the medium and that performs recording by ejecting liquid on the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

First, the outline of a recording apparatus according to a first embodiment of the invention will be described. Examples of a recording apparatus according to the present embodiment include an ink jet printer 1 (hereinafter, simply referred to as printer 1 in some cases).

Figure 1:
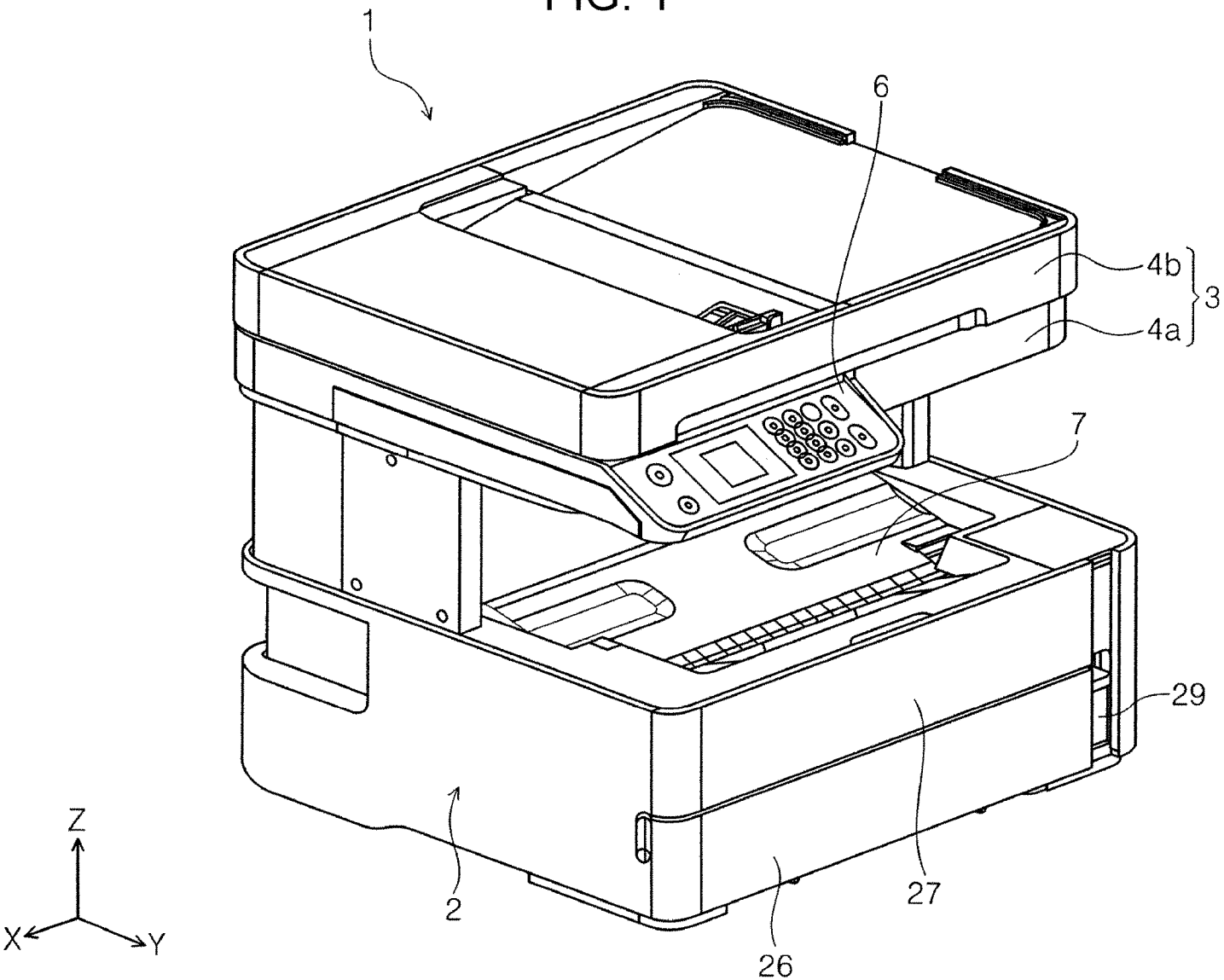
FIG. 1 is a perspective view illustrating an outer appearance of a printer according to a first embodiment.
Figure 2:
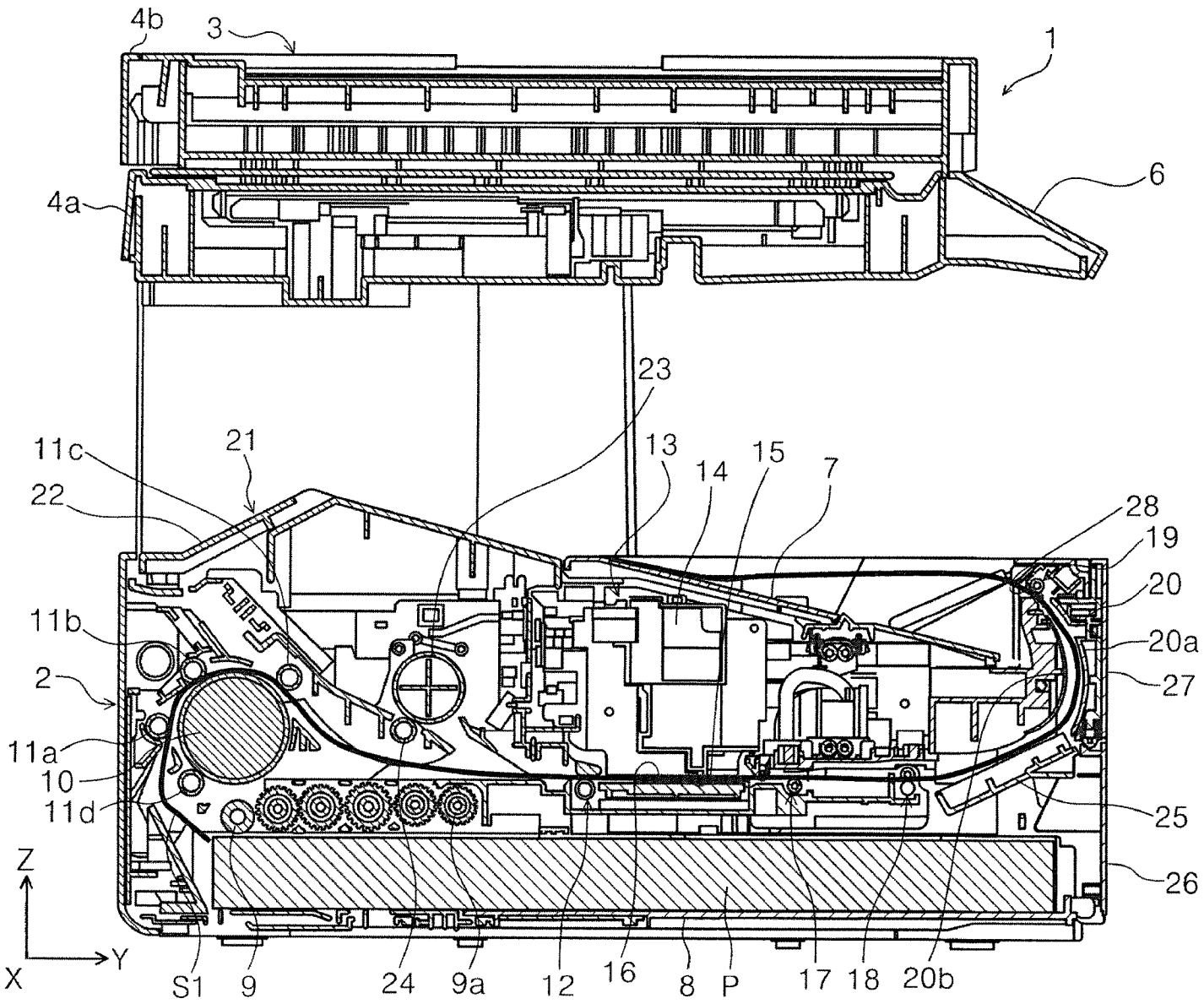
FIG. 2 is a side sectional view illustrating a transportation path of a paper sheet that is transported from a medium accommodation unit of the printer according to the first embodiment.
Figure 3:
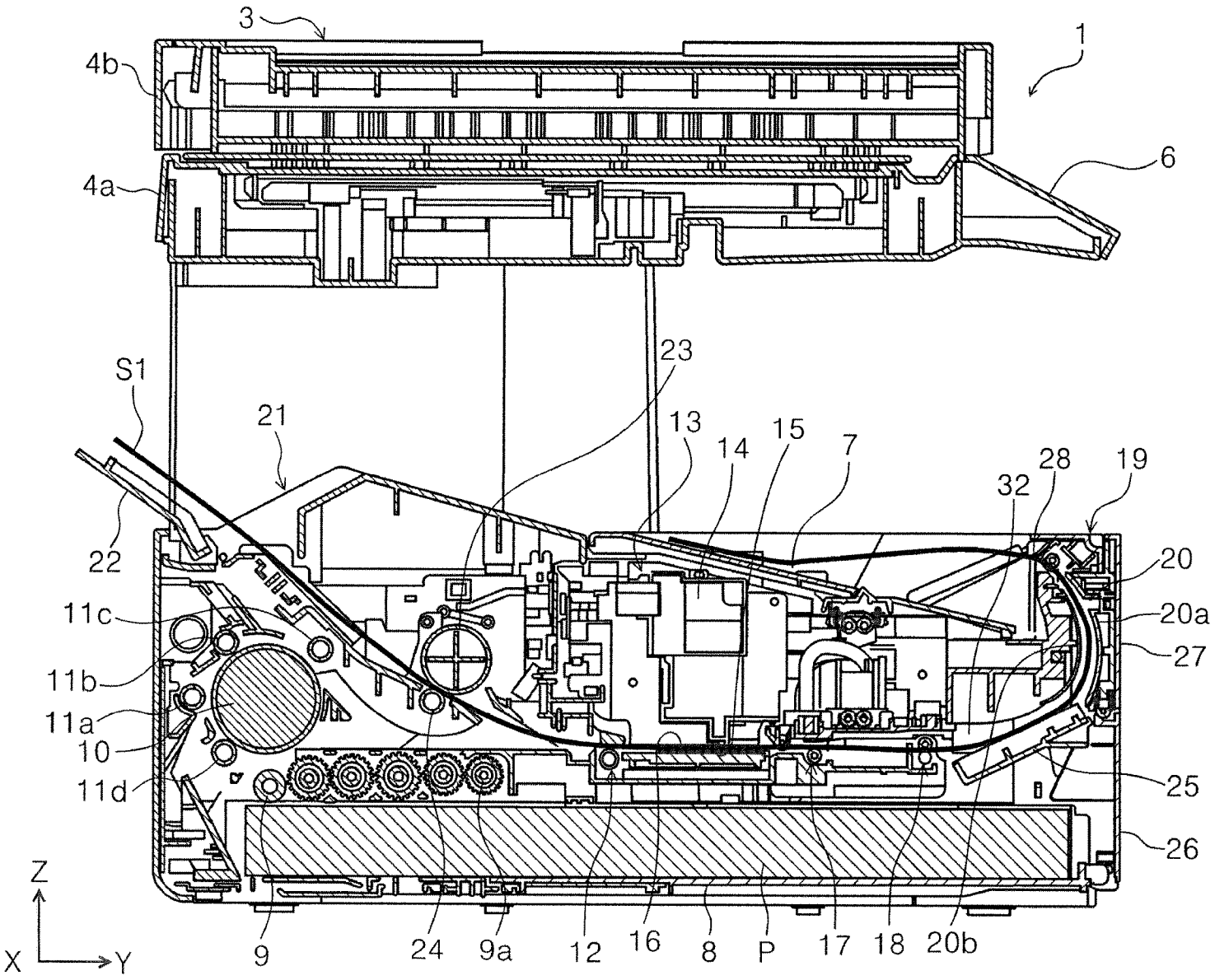
FIG. 3 is a side sectional view illustrating a transportation path of a paper sheet that is transported from a rear surface side feeding unit of the printer according to the first embodiment.
Figure 4:
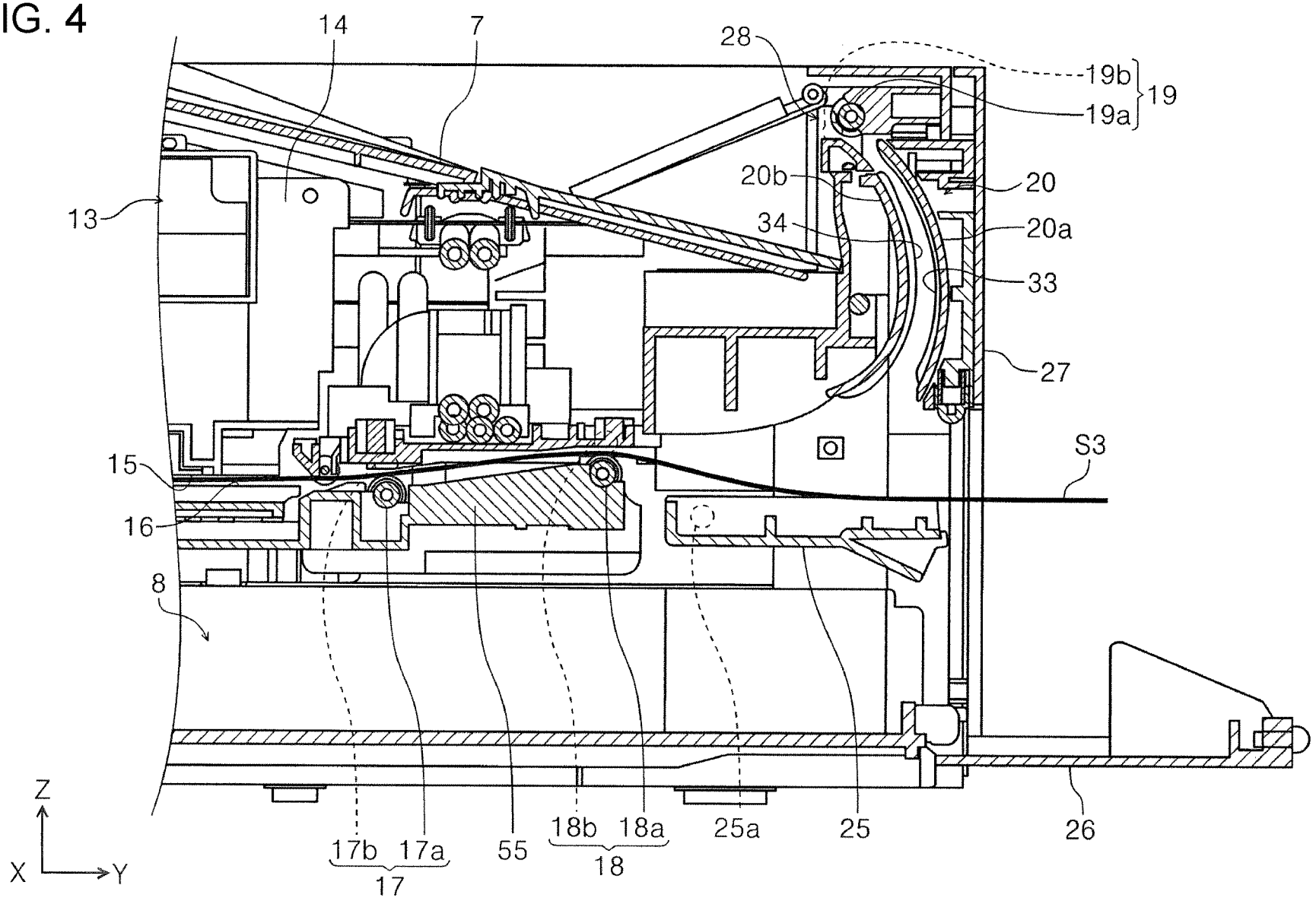
FIG. 4 is a side sectional view illustrating a supporting portion that is in a second state with a first cover of the printer according to the first embodiment opened.
Figure 5:
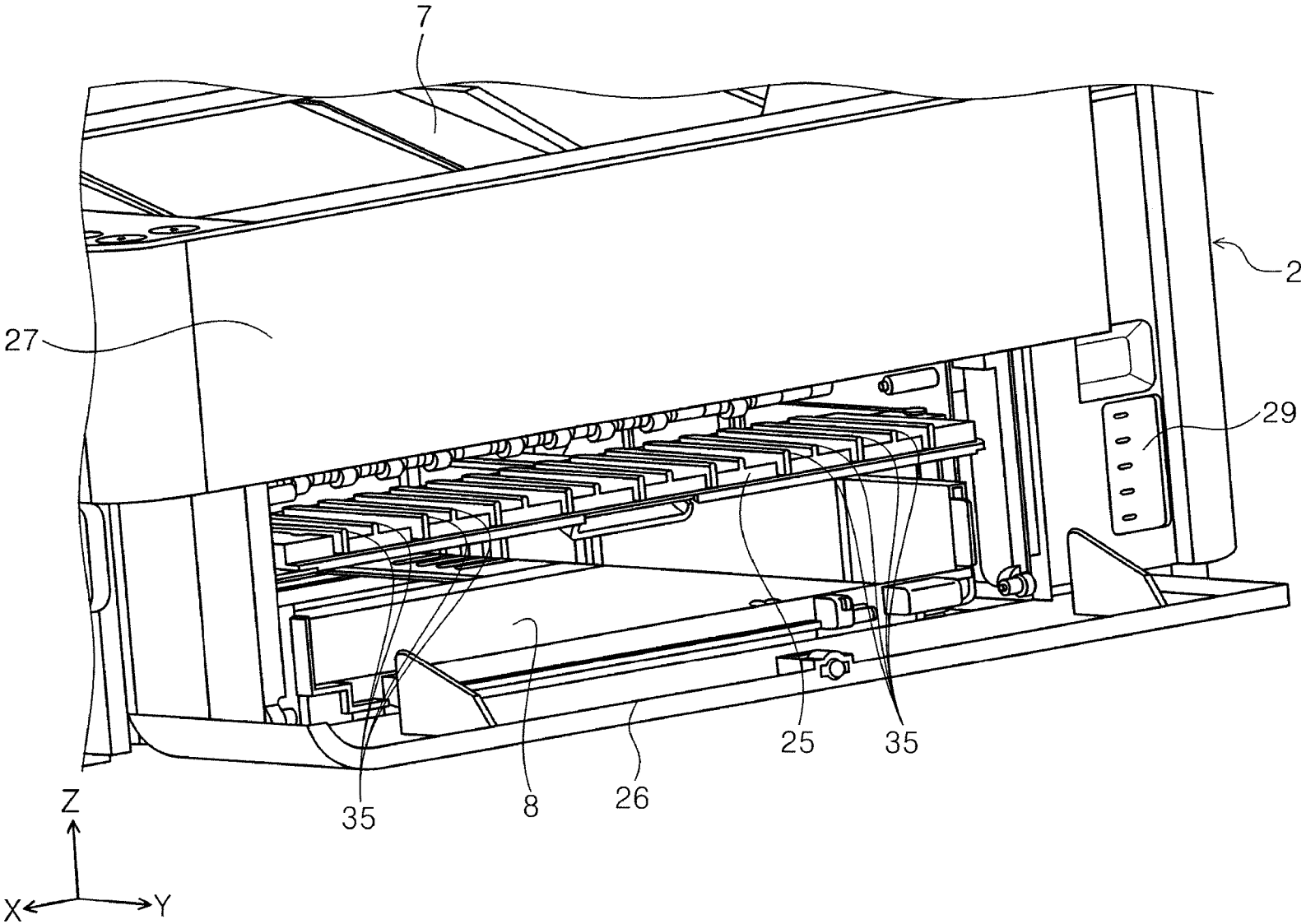
FIG. 5 is a perspective view illustrating the supporting portion that is in the second state with the first cover of the printer according to the first embodiment opened.
Figure 6:
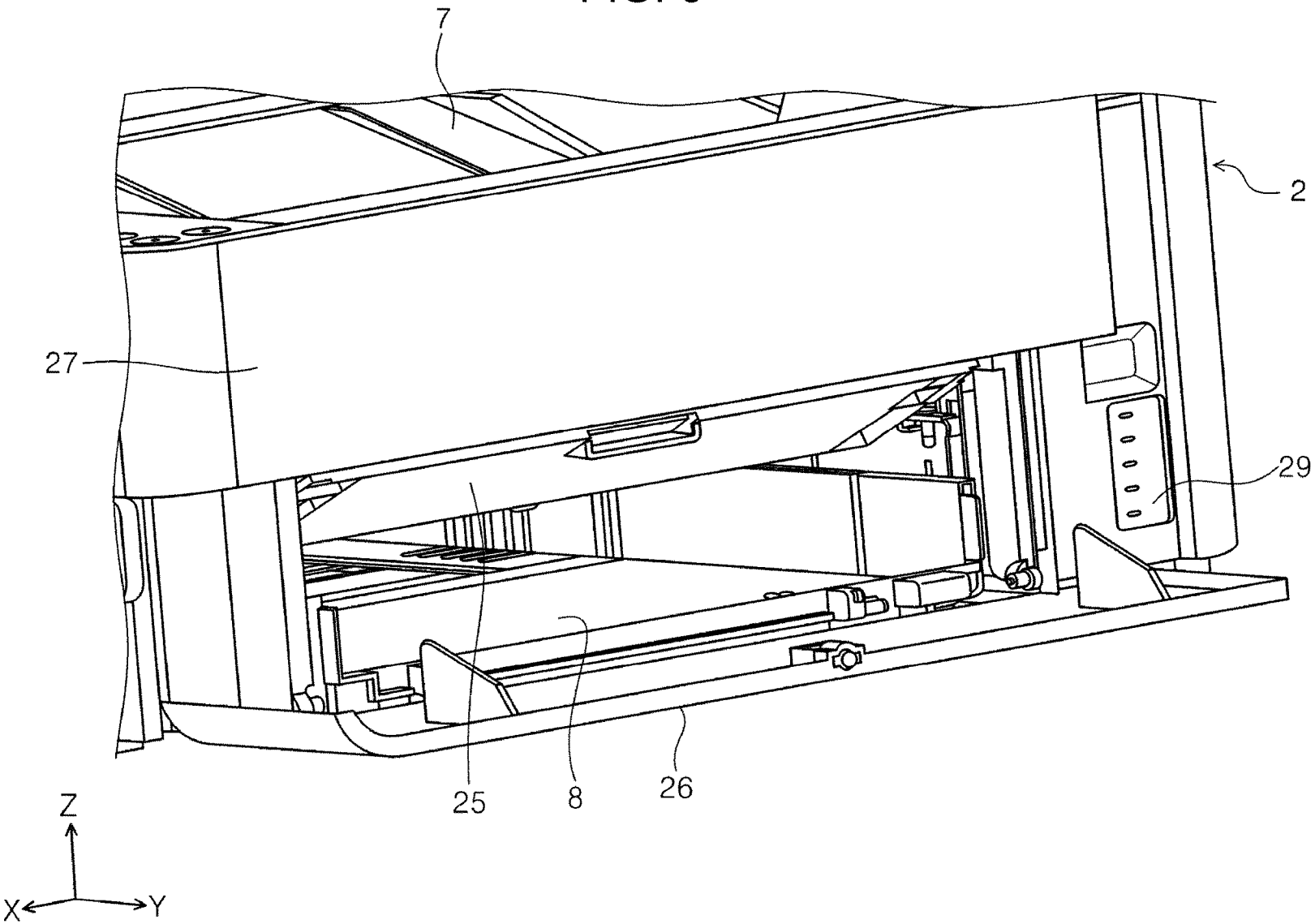
FIG. 6 is a perspective view illustrating the supporting portion that is in a first state with the first cover of the printer according to the first embodiment opened.
Figure 7:
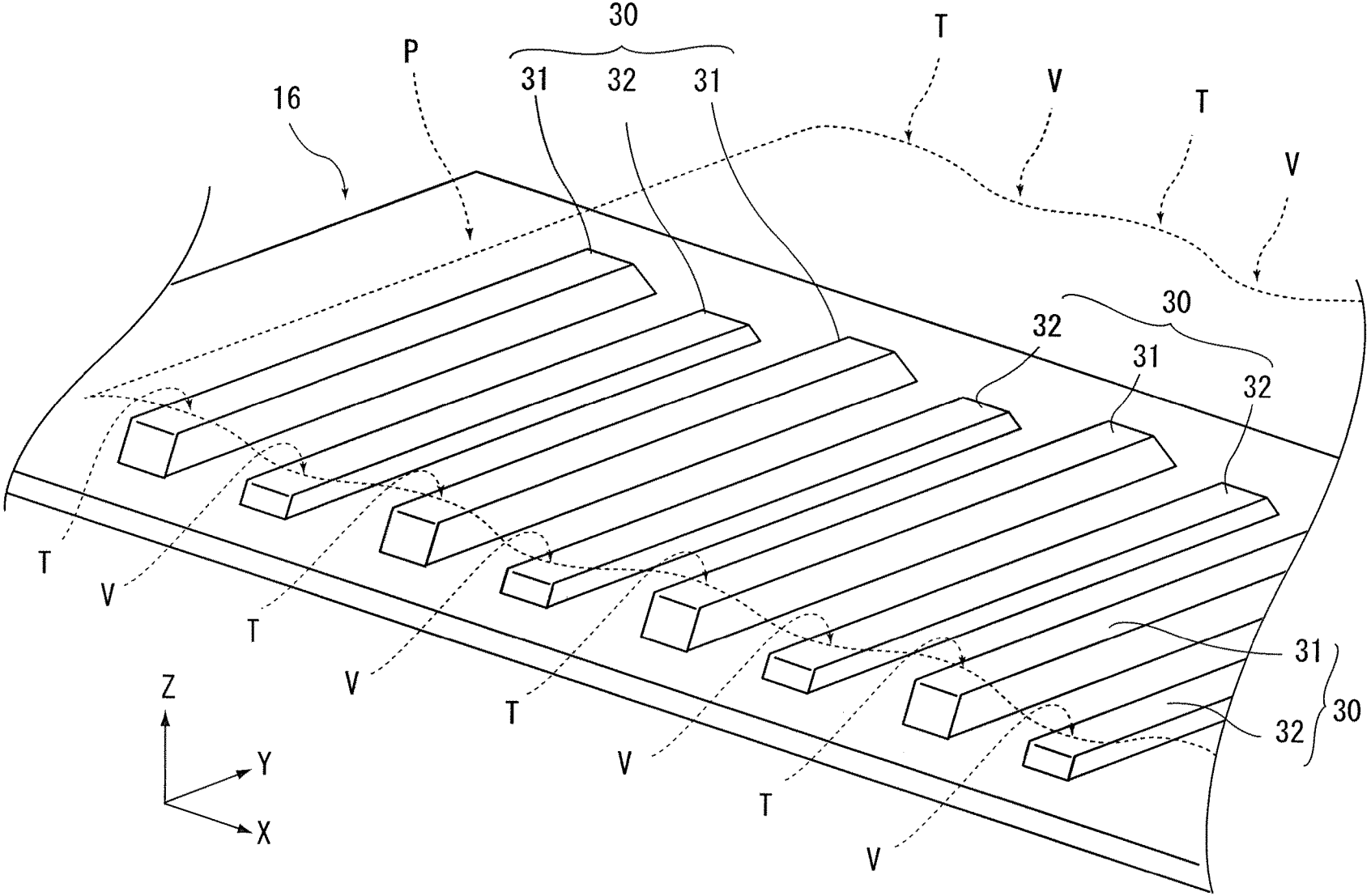
FIG. 7 is a schematic perspective view of a medium supporting portion.

FIG. 1 is a perspective view illustrating an outer appearance of a printer according to the first embodiment. FIG. 2 is a side sectional view illustrating a transportation path of a paper sheet that is transported from a medium accommodation unit of the printer according to the first embodiment. FIG. 3 is a side sectional view illustrating a transportation path of a paper sheet that is transported from a rear surface side feeding unit of the printer according to the first embodiment. FIG. 4 is a side sectional view illustrating a supporting portion that is in a second state with a first cover of the printer according to the first embodiment opened. FIG. 5 is a perspective view illustrating the supporting portion that is in the second state with the first cover of the printer according to the first embodiment opened. FIG. 6 is a perspective view illustrating the supporting portion that is in a first state with the first cover of the printer according to the first embodiment opened. FIG. 7 is a schematic perspective view of a medium supporting portion.

Figure 8:
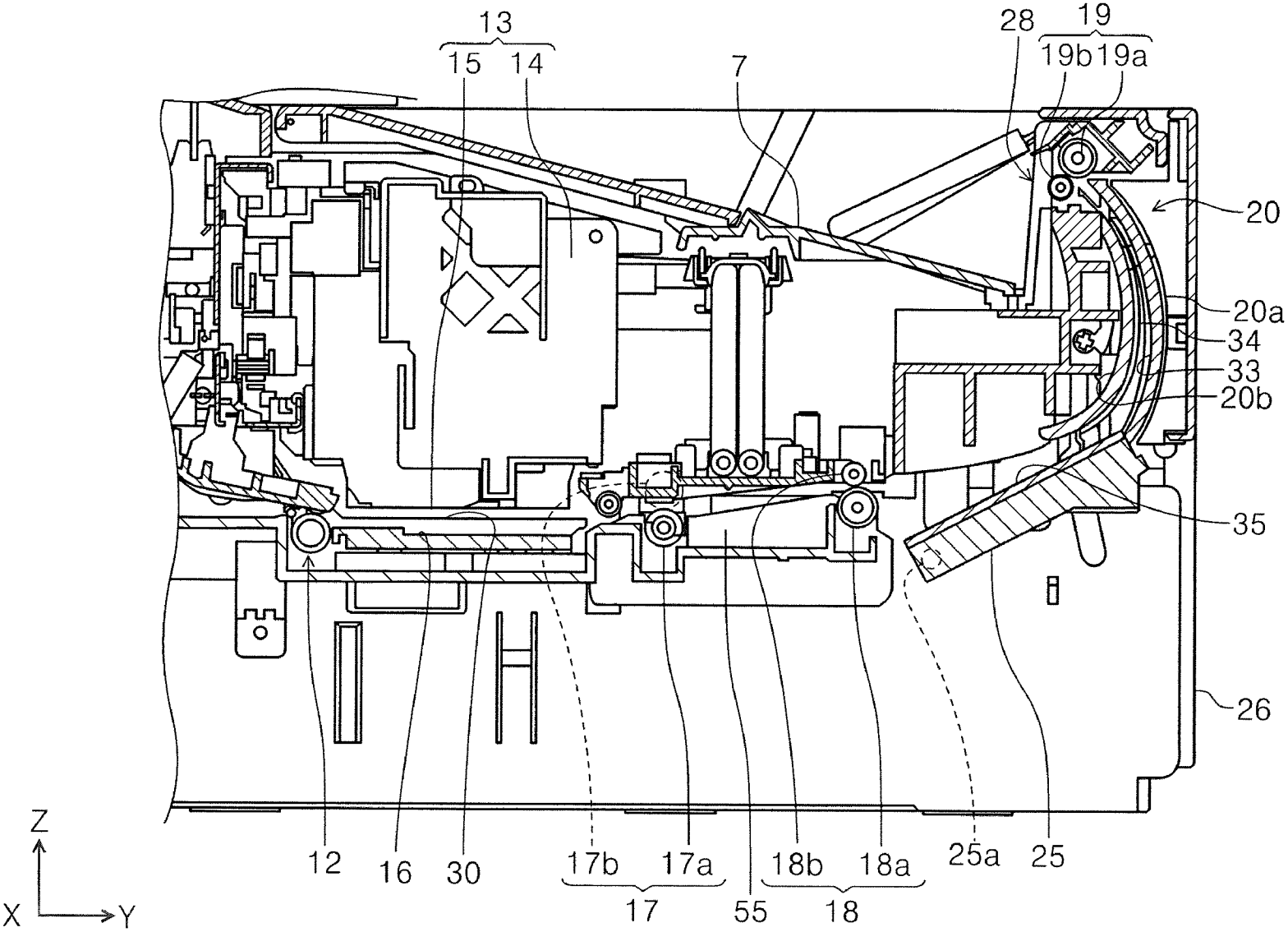
FIG. 8 is an enlarged view illustrating a main part of FIG. 2.
Figure 9:
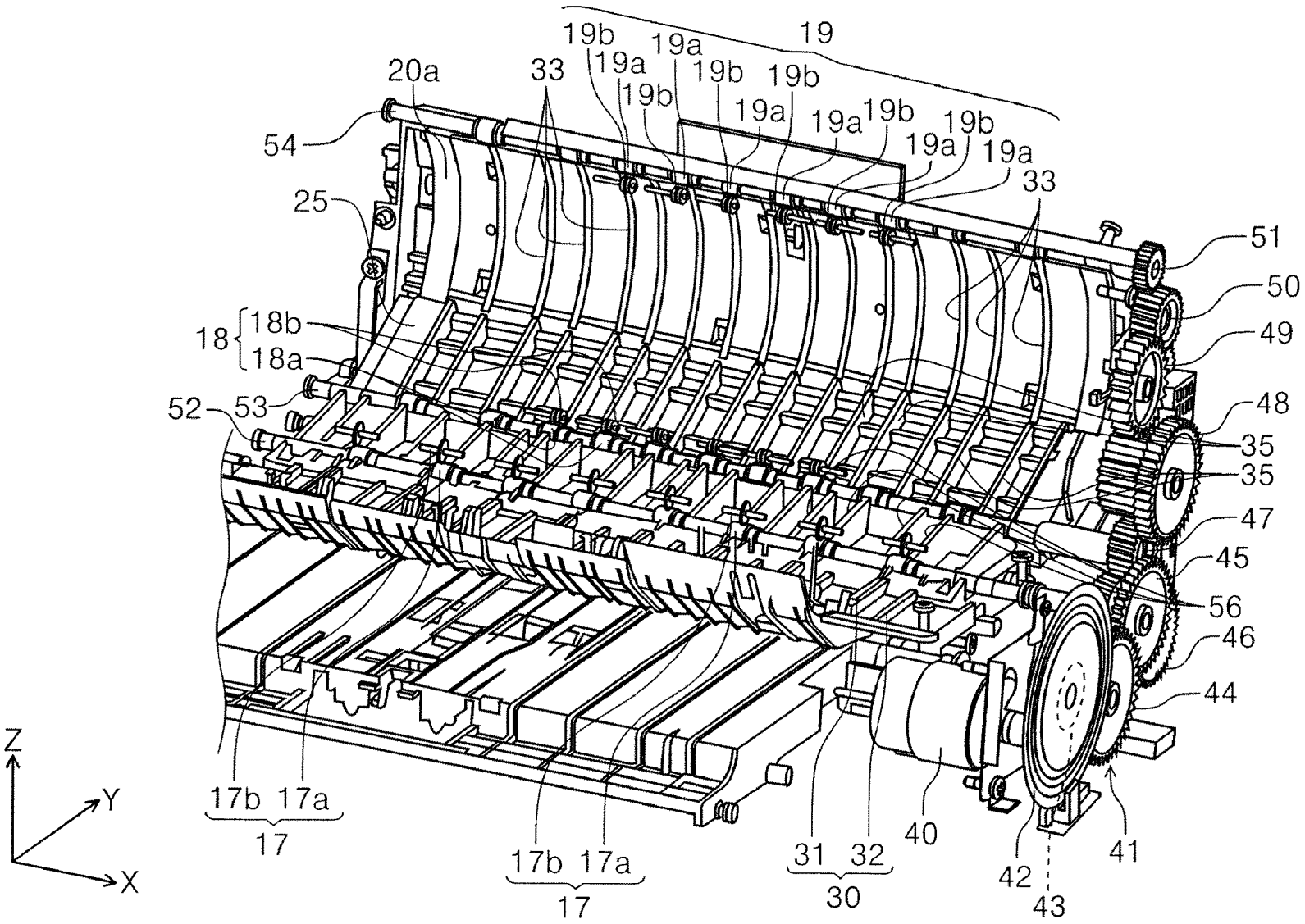
FIG. 9 is a perspective view illustrating a state where an inner curved portion of a curved path is removed.
Figure 10:
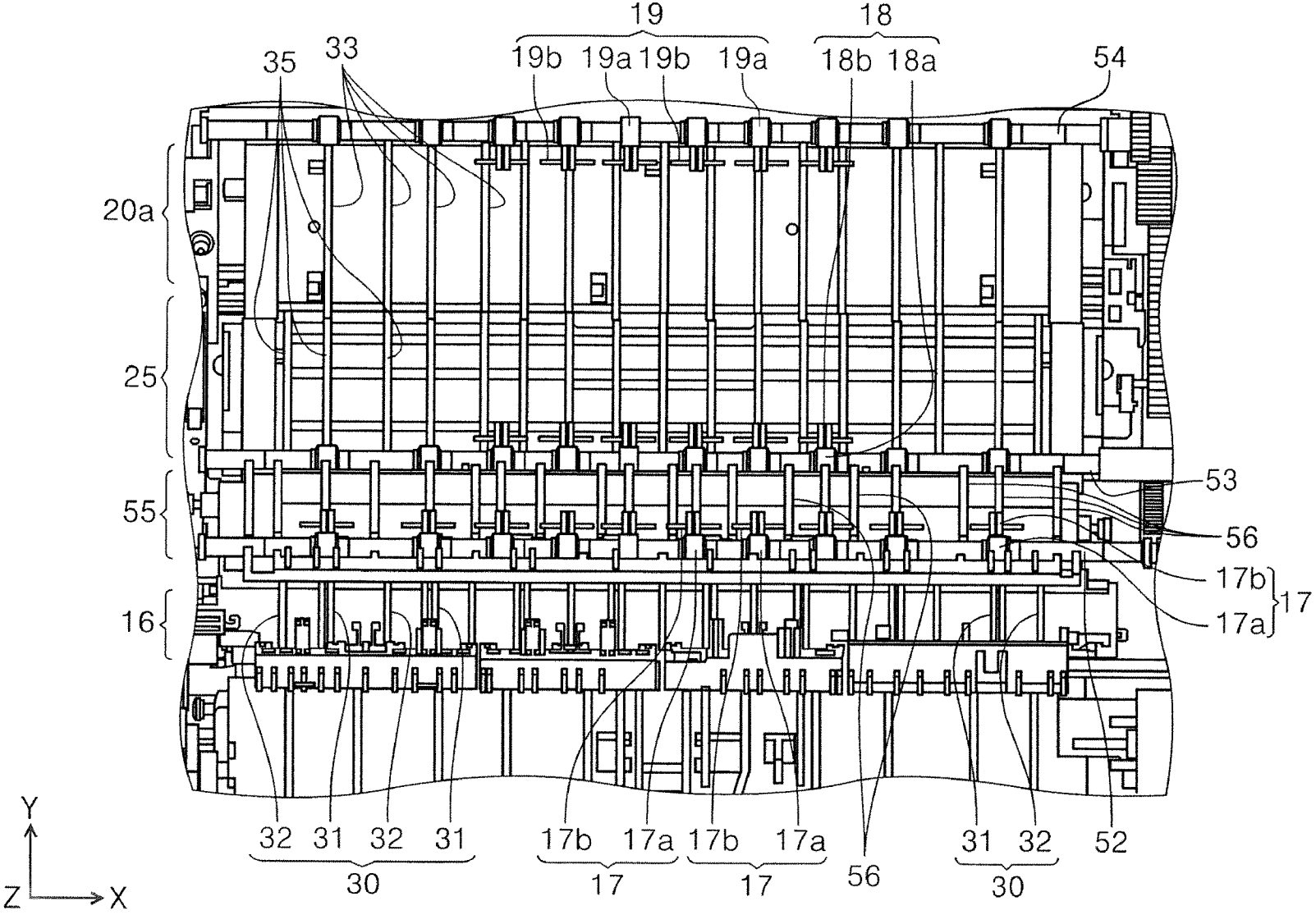
FIG. 10 is a plan view of FIG. 9.
Figure 11:
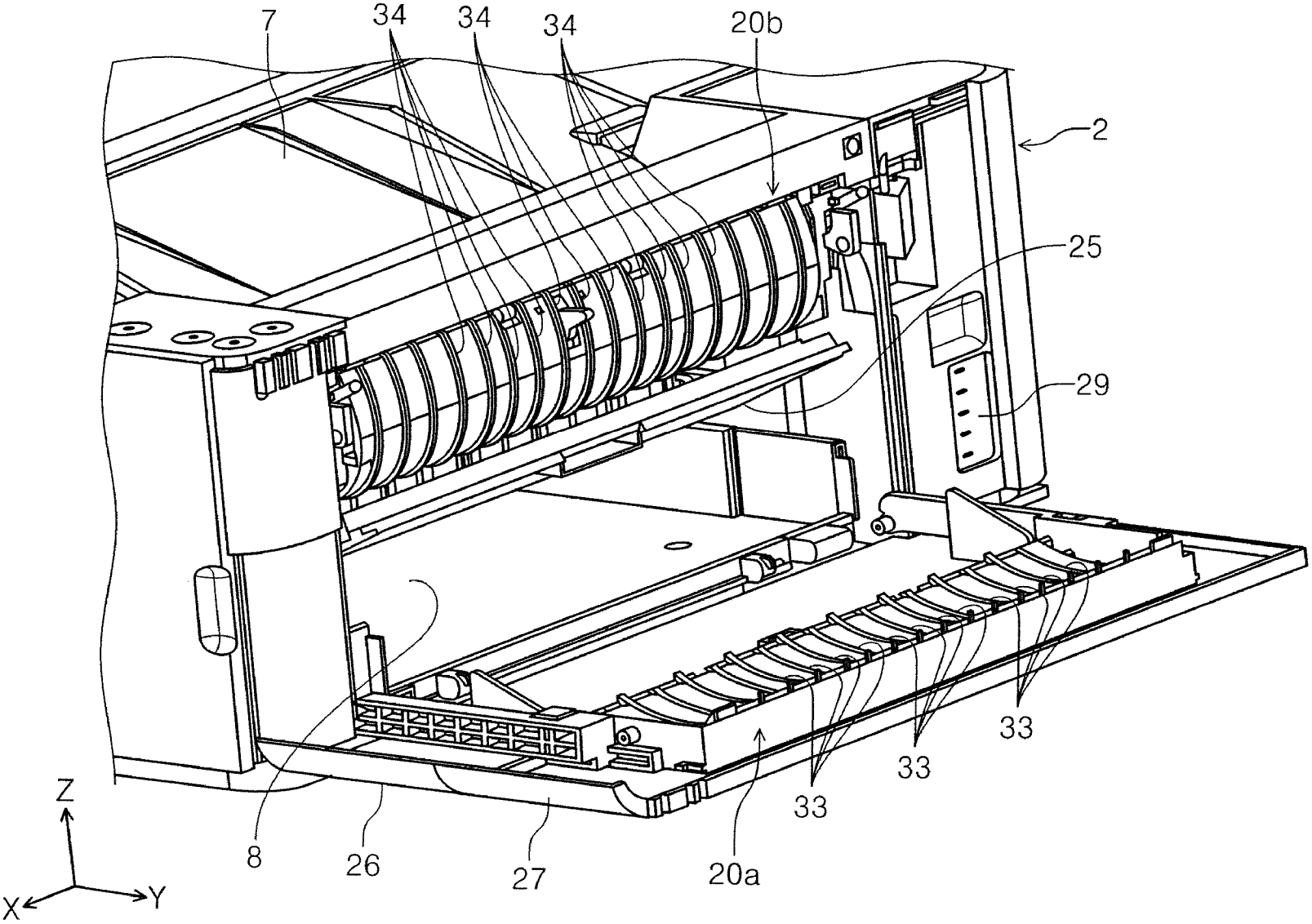
FIG. 11 is a perspective view illustrating a state where the first cover and a second cover of the printer according to the first embodiment are open.
Figure 12:
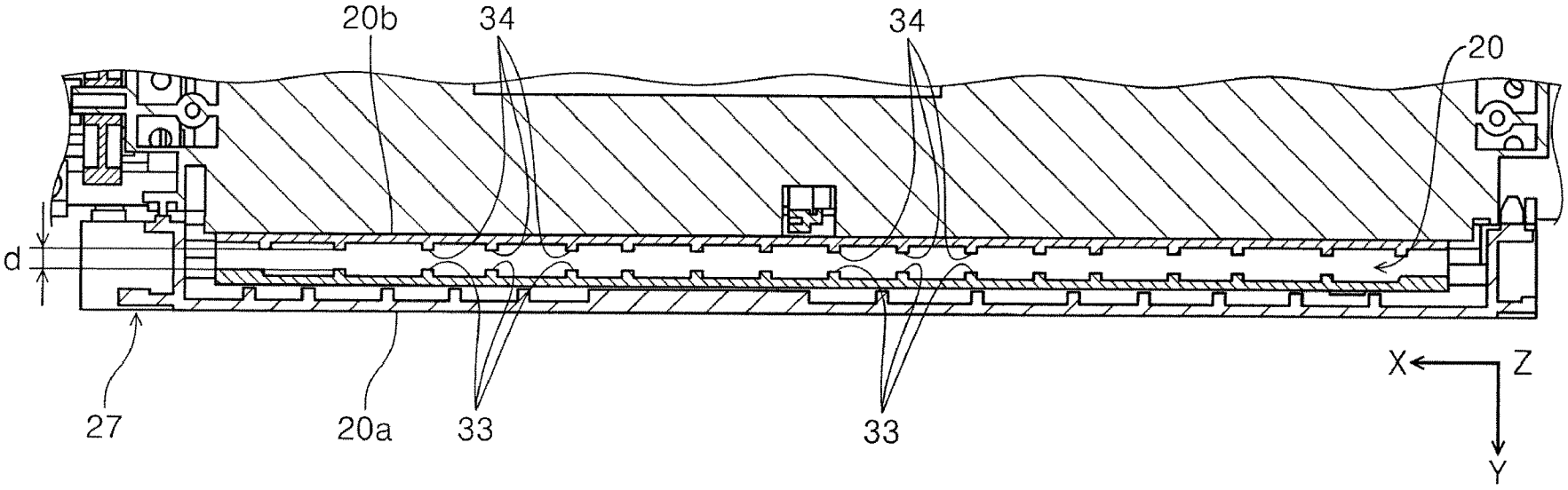
FIG. 12 is a sectional view of an XY plane of the curved path.
Figure 13:
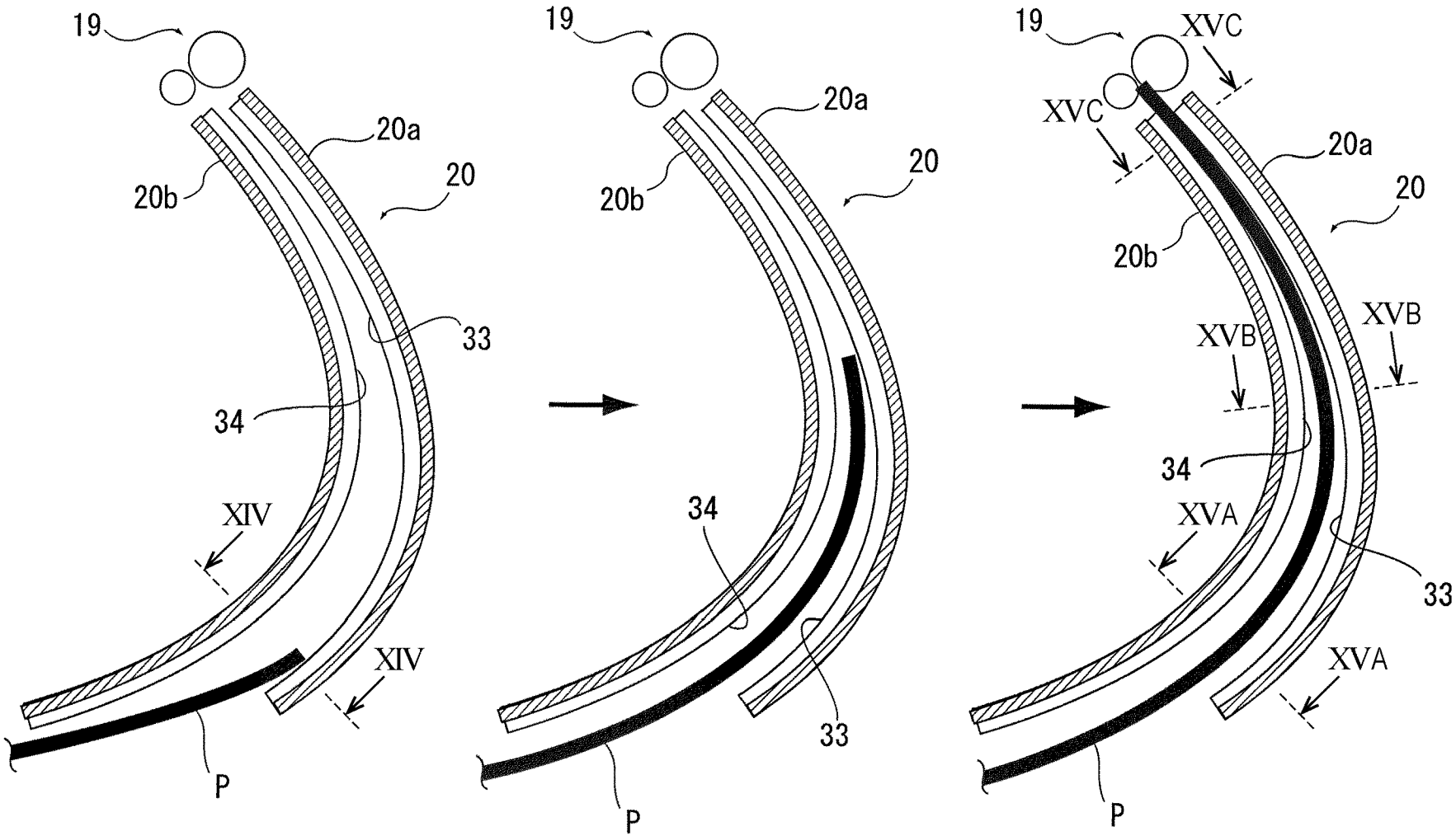
FIG. 13 is a view for explaining transportation of a paper sheet in the curved path.
Figure 14:
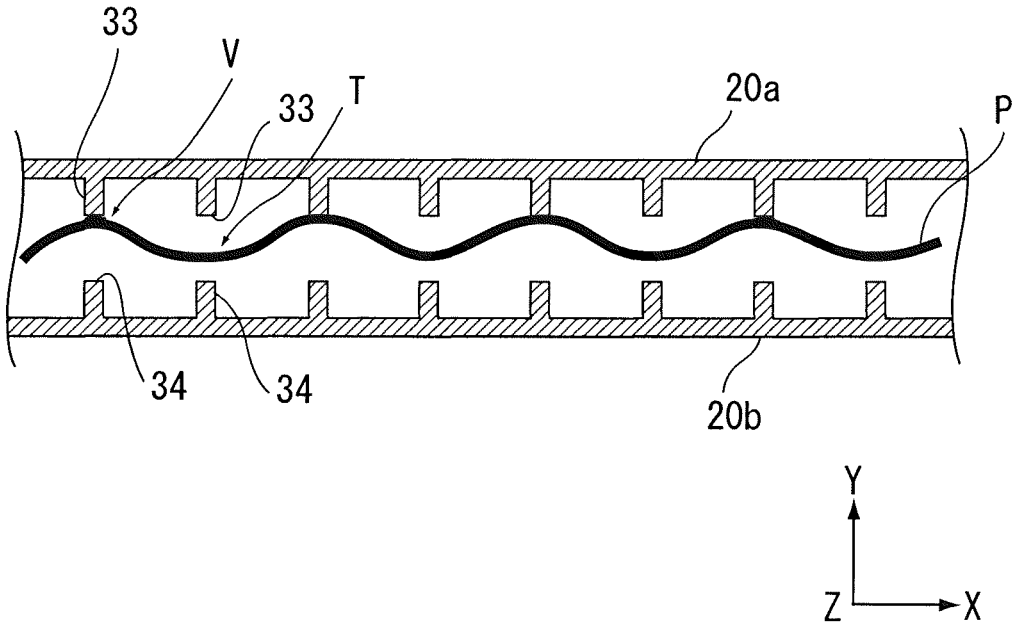
FIG. 14 is a sectional view taken along line XIV-XIV in the left drawing of FIG. 13.
Figure 15A:
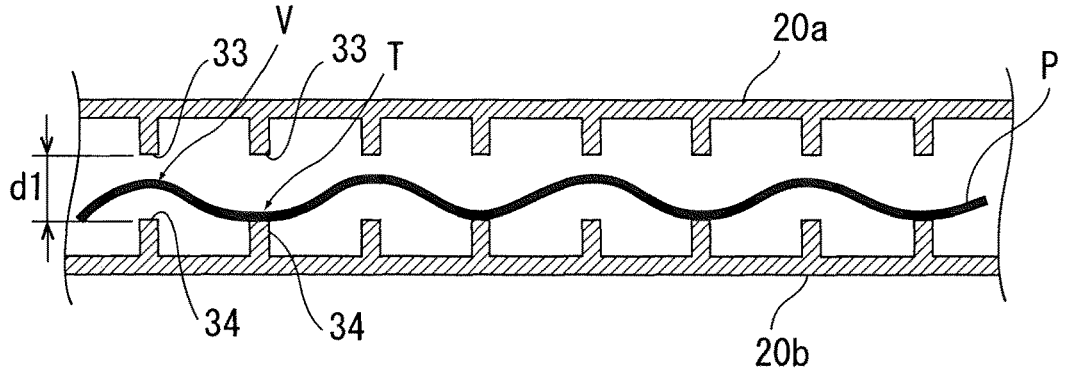
FIGS. 15A to 15C are views for explaining the curved path that becomes narrower toward a downstream side from an upstream side in a medium transportation direction.
Figure 15B:
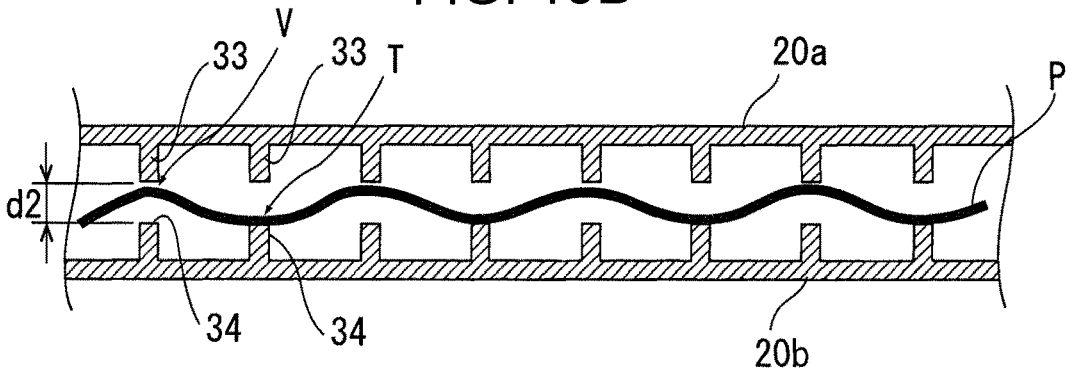
Figure 15C:
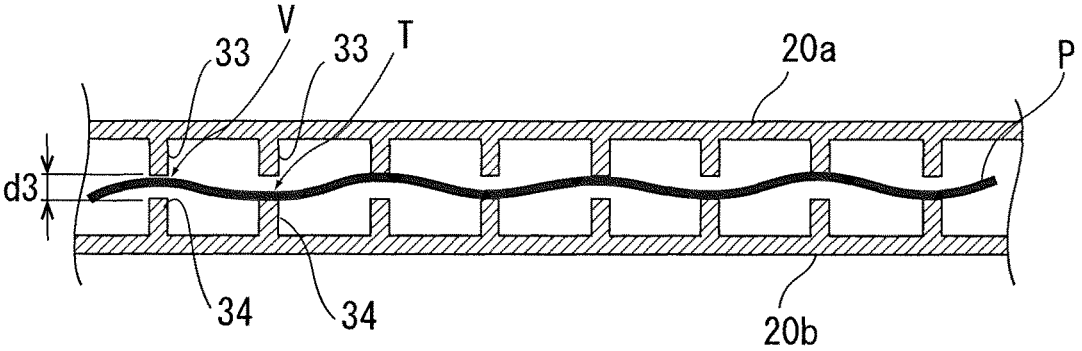
Figure 15C:
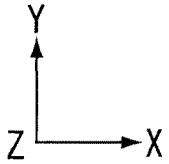
Figure 16:
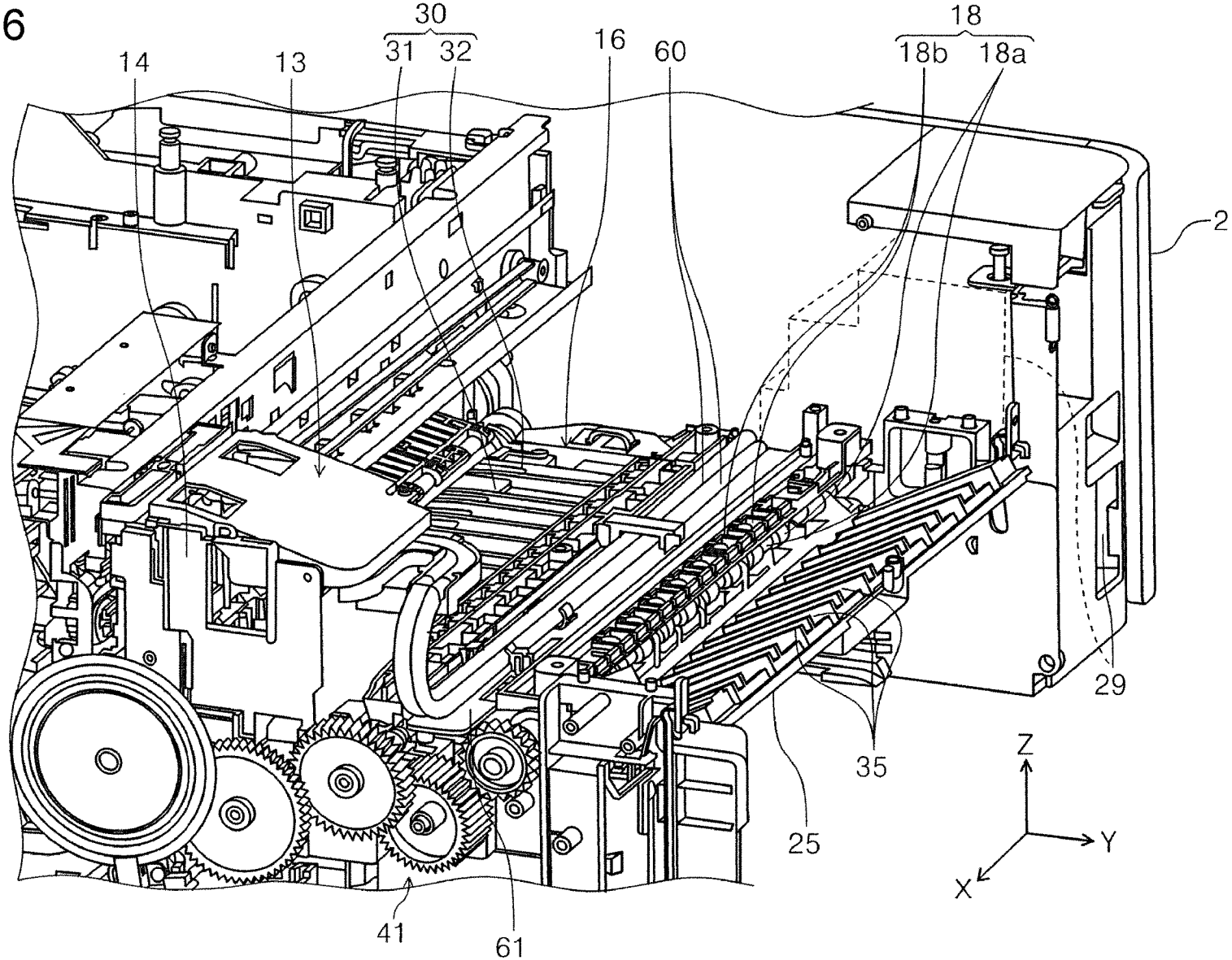
FIG. 16 is a perspective view illustrating a state where a carriage of the printer according to the first embodiment is positioned at an end portion in a +X direction.
Figure 17:
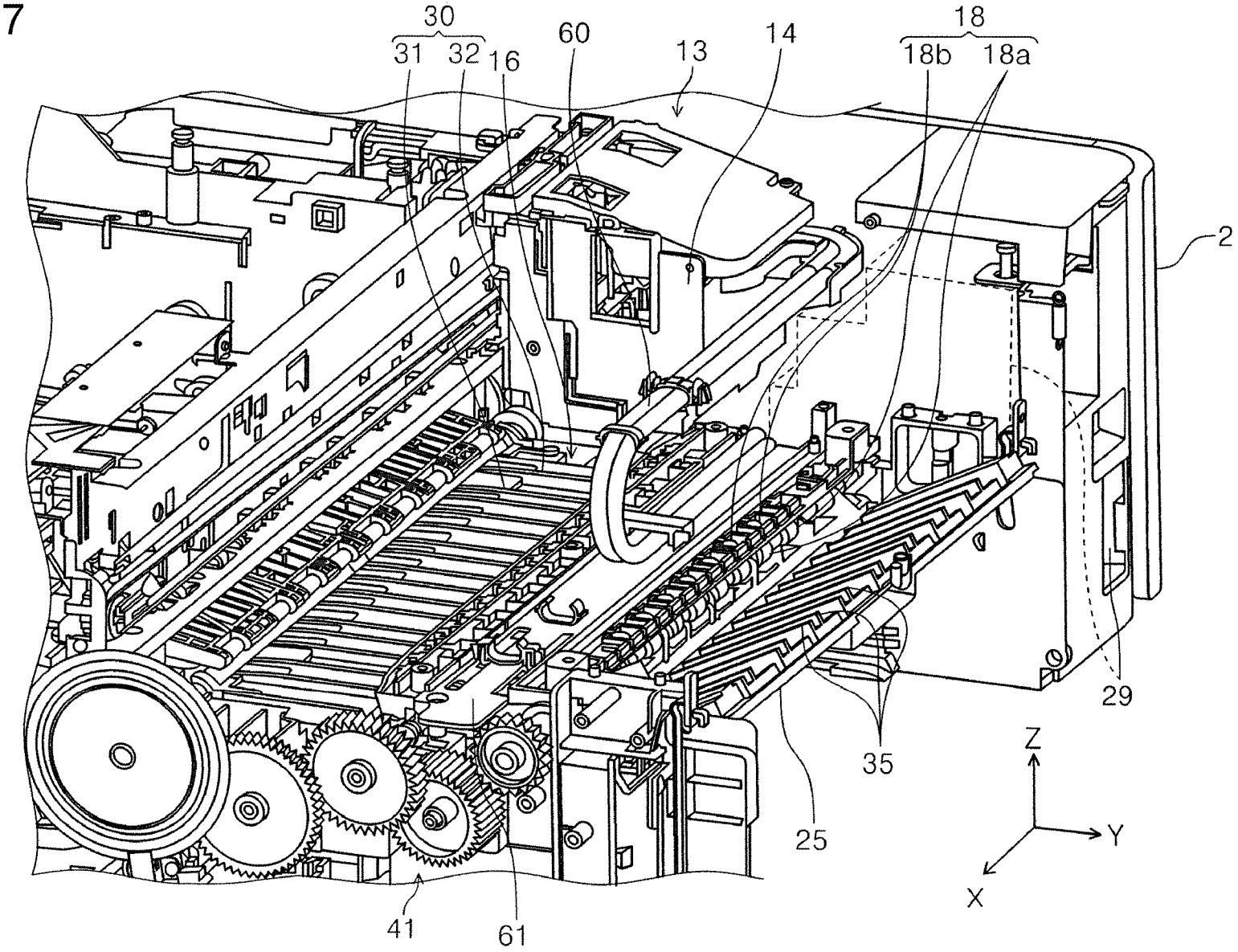
FIG. 17 is a perspective view illustrating a state where the carriage of the printer according to the first embodiment is positioned at an end portion in a −X direction.

FIG. 8 is an enlarged view illustrating a main part of FIG. 2. FIG. 9 is a perspective view illustrating a state where an inner curved portion of a curved path is removed. FIG. 10 is a plan view of FIG. 9. FIG. 11 is a perspective view illustrating a state where the first cover and a second cover of the printer according to the first embodiment are open. FIG. 12 is a sectional view of an XY plane of the curved path. FIG. 13 is a view for explaining transportation of a paper sheet in the curved path. FIG. 14 is a sectional view taken along line XIV-XIV in the left drawing of FIG. 13. FIGS. 15A to 15C are views for explaining the curved path that becomes narrower toward a downstream side from an upstream side in a medium transportation direction. FIG. 16 is a perspective view illustrating a state where a carriage of the printer according to the first embodiment is positioned at an end portion in a +X direction. FIG. 17 is a perspective view illustrating a state where the carriage of the printer according to the first embodiment is positioned at an end portion in a −X direction.

In addition, in an X-Y-Z coordinates system in each drawing, an X axis direction is a width direction of the paper sheet and an apparatus width direction, a Y axis direction is a transportation direction (medium transportation direction) of the paper sheet in a transportation path in the recording apparatus and an apparatus depth direction, and a Z axis direction is an apparatus height direction. In addition, a direction in which a paper sheet as an example of a "medium" is transported will be referred to as a direction toward a downstream side and the opposite of the direction as described above will be referred to as a direction toward an upstream side.

Outline of Printer

With reference to FIG. 1, the entire configuration of the printer 1 will be described. The printer 1 is configured as a multifunction machine provided with a casing 2 and a scanner unit 3.

The scanner unit 3 is provided with a scanner main body 4*a* and an ADF unit 4*b*. A +Y direction side end portion of the scanner main body 4*a* is provided with an operation unit 6. The operation unit 6 is provided with a plurality of operation buttons and a display panel. In the present embodiment, the operation unit 6 is configured such that a recording operation in the printer 1 and an image reading operation in the scanner unit 3 can be operated.

A first discharge tray 7 is attached to an upper portion of the casing 2 such that the first discharge tray 7 can rotate with respect to the casing 2. In the present embodiment, the first discharge tray 7 is configured to receive a medium discharged from the inside of the casing 2 while being inclined.

Medium Transportation Path of Printer

Medium Transportation Path from Medium Accommodation Unit to First Discharge Tray Mainly with reference to FIG. 2, a medium transportation path S1 (illustrated by solid line in FIG. 2) from a medium accommodation unit 8 to the first discharge tray 7 will be described, the medium accommodation unit 8 being provided in a lower portion of the casing 2.

In FIG. 2, a −Z direction side end portion of the casing 2 is provided with the medium accommodation unit 8. The medium accommodation unit 8 is configured to be able to accommodate a plurality of paper sheets. A pickup roller 9 is provided on a +Z direction side of the medium accommodation unit 8. The pickup roller 9 is configured to be able to rotate about a rotary shaft 9*a*. The pickup roller 9 comes into contact with a paper sheet P accommodated in the medium accommodation unit 8 such that the uppermost paper sheet P among media accommodated in the medium accommodation unit 8 is transported to the downstream side in the medium transportation direction.

On the downstream side of the pickup roller 9, an inversion roller 10 and driven rollers 11*a*, 11*b*, 11*c*, and 11*d*, which are disposed in the vicinity of the inversion roller 10 and rotate in accordance with rotation of the inversion roller 10, are provided.

The paper sheet P fed by the pickup roller 9 is inverted by the inversion roller 10 and is fed to a pair of feeding rollers 12 that is provided on the downstream side in the medium transportation direction. On the downstream side of the pair of feeding rollers 12 in the medium transportation direction, a recording unit 13 is provided.

The recording unit 13 is a "processing unit" that performs processing on a paper sheet in the printer 1 and performs a recording process of performing recording by ejecting ink as "liquid" on the paper sheet. The recording unit 13 is configured to be provided with a carriage 14. The carriage 14 is configured to be able to move in the X axis direction and a lower portion thereof is provided with a recording head 15 that discharges ink in a −Z direction.

Ink supplied to the recording unit 13 is fed from an ink tank 29 (FIG. 1) provided on a +X axis direction side in the casing 2 via supply tube 60 (FIGS. 16 and 17) which will be described.

Below the recording head 15, a medium supporting portion 16 is provided in an area facing the recording head 15. The medium supporting portion 16 supports a lower surface (surface opposite to recording surface) of the paper sheet P transported by the pair of feeding rollers 12 to the area facing the recording head 15.

As illustrated in FIG. 7, the medium supporting portion 16 is provided with first ribs 30 for forming so-called cockling on the transported paper sheet P. The cockling is a wave-like shape formed by mountain portions T and valley portions V extending in the medium transportation direction (Y axis direction) and alternately positioned in the width direction (X axis direction). Since the rigidity of the paper sheet on which the cockling is formed is increased, the posture of the medium on the medium supporting portion 16 is stabilized and thus a favorable recording quality can be achieved. In the present embodiment, the first ribs 30 constitute a medium transporting device 5 that transports the paper sheet P. A specific configuration of the medium supporting portion 16 including the first ribs 30 will be described later in detail.

The recording head 15 discharges ink onto the paper sheet P supported by the medium supporting portion 16 to perform recording on the recording surface of the paper sheet P.

On the downstream side of the recording head 15 in the medium transportation direction, pairs of first rollers 17 as a "first transportation unit" are provided. As illustrated in FIG. 8, each pair of first rollers 17 includes a first driving roller 17*a* that is driven by a motor 40 (FIG. 9) as a drive source and a first serrated roller 17*b* that rotates in accordance with rotation of the first driving roller 17*a* and has a plurality of teeth on an outer circumference thereof. The pairs of first rollers 17 are components that are provided between the recording unit 13 and pairs of upstream side rollers 18 (which will be described later) and that transport a paper sheet.

On the downstream side of the pairs of first rollers 17 in the medium transportation direction, a curved path 20 that constitutes the medium transporting device 5 and in which a paper sheet is curved and inverted is provided. On the upstream side of the curved path 20 in the medium transportation direction, the pairs of upstream side rollers 18 as "upstream side transportation parts" that transport a paper sheet fed from the pairs of first rollers 17 to the curved path 20 are provided. As illustrated in FIG. 8, each pair of upstream side rollers 18 includes an upstream side driving roller 18*a* and an upstream side serrated roller 18*b* that rotates in accordance with rotation of the upstream side driving roller 18*a* and has a plurality of teeth on an outer circumference thereof. The upstream side driving roller 18*a* is driven by the motor 40 (FIG. 9).

On the downstream side of the curved path 20 in the medium transportation direction, pairs of downstream side rollers 19 as "downstream side transportation parts" that discharge the paper sheet from the curved path 20 are provided. As illustrated in FIG. 8, each pair of downstream side rollers 19 includes a downstream side driving roller 19*a* and a downstream side serrated roller 19*b* that rotates in accordance with rotation of the downstream side driving roller 19*a* and has a plurality of teeth on an outer circumference thereof. The downstream side driving roller 19*a* is driven by the motor 40 (FIG. 9).

A paper sheet that is discharged from the curved path 20 by the pairs of downstream side rollers 19 is placed on the first discharge tray 7 after being discharged from a discharge section 28. Note that, as with the medium supporting portion 16, the configuration of the curved path 20 will be also described later in detail.

In addition, in the present embodiment, on the downstream side of the pairs of upstream side rollers 18 in the medium transportation direction, a supporting portion 25 that supports a paper sheet is provided. The supporting portion 25 is configured to be able to be displaced between a first state in which a path from the pairs of upstream side rollers 18 to the curved path 20 is formed as illustrated in FIG. 2 and a second state in which a path to a transportation destination (discharge section) different from the first discharge tray 7 is formed as illustrated in FIG. 4. Discharge of the paper sheet to the supporting portion 25 will be described below after transportation of the paper sheet from a rear surface side feeding part 21 is described.

Medium Transportation Path from Rear Surface Side Feeding Unit to First Discharge Tray Next, in FIG. 3, transportation of a paper sheet from the rear surface side feeding unit 21 will be described. A −Y direction side end portion of the casing 2 is provided with the rear surface side feeding unit 21. The rear surface side feeding unit 21 is provided with a feeding port cover 22. The feeding port cover 22 is configured to be able to rotate with respect to the casing 2 and can switch between a closed state (FIG. 2) and an opened state (FIG. 3). When the feeding port cover 22 is in the opened state, a paper sheet can be fed to the recording unit 13 in the casing 2 from the rear surface side feeding unit 21. Note that, in FIG. 3, a thick line denoted by a reference symbol "S2" represents a medium transportation path of the paper sheet P fed from the rear surface side feeding unit 21.

On the downstream side of the feeding port cover 22, a feeding roller 23 and a separation roller 24 are provided. A medium set in the rear surface side feeding unit 21 is transported while being nipped by the feeding roller 23 and the separation roller 24 and joins the medium transportation path S1 from the medium accommodation unit 8 (which has been described above) on the upstream side of the pair of feeding rollers 12. Thereafter, as with the medium transportation path S1 illustrated in FIG. 2, the paper sheet is fed to the recording unit 13, the recording is performed, and the paper sheet is discharged to the first discharge tray 7 through the curved path 20.

Discharge to Second Discharge Tray (Supporting Portion)

As described above, the printer 1 not only can discharge a paper sheet after recording that is performed by the recording unit 13 to the first discharge tray 7 but also can discharge the paper sheet with the supporting portion 25, which is disposed on a +Y direction side of the casing 2, as a second discharge tray as illustrated in FIG. 4. In FIG. 4, a thick line denoted by a reference symbol "S3" represents a medium transportation path through which a medium is discharged to the supporting portion 25 in the second state, which will be described later.

The supporting portion 25 is provided with a rotary shaft 25*a* and pivots around the rotary shaft 25*a* in the first state (FIG. 2) in which a path related to a case where a paper sheet after recording is discharged to the first discharge tray 7 through the curved path 20 is formed such that the supporting portion 25 enters the second state (FIG. 4) in which the path toward the transportation destination different from the first discharge tray 7 is formed.

A +Y direction side surface of the casing 2 illustrated in FIG. 1, that is, a front surface of the casing 2 is provided with a first cover 26. As illustrated in FIG. 4, the first cover 26 is provided such that the first cover 26 can be opened and closed with respect to the casing 2. The first cover 26 is configured to rotate with a lower end portion side of the casing 2 as a fulcrum and a +Z direction side end portion of the first cover 26 is configured as a free end.

As illustrated in FIG. 6, when the first cover 26 is opened, the supporting portion 25 and the medium accommodation unit 8 are partially exposed. When the first cover 26 is opened, a portion of the medium accommodation unit 8 can be drawn out to the +Y direction side of the casing 2 and thus it is possible to easily supply a medium to the medium accommodation unit 8.

Note that, in FIG. 5, the supporting portion 25 is in the second state (state illustrated in FIG. 4) and in FIG. 6, the supporting portion 25 is in the first state (state illustrated in FIGS. 2 and 3).

When the first cover 26 is opened and the supporting portion 25 enters the second state (state illustrated in FIGS. 4 and 5), the paper sheet after recording that is performed by the recording unit 13 is fed by the pairs of first rollers 17 and the pairs of upstream side rollers 18 and is discharged from an apparatus front surface side (+Y direction side) of the casing 2 while being supported by the supporting portion 25 in the second state.

Medium Supporting Portion

With reference to FIG. 7, the medium supporting portion 16 will be described.

As described above, the medium supporting portion 16 that is disposed in a facing area facing the recording unit 13 (processing unit) is provided with the plurality of first ribs 30 for forming a wave-like shape (cockling) on a transported paper sheet as illustrated in FIG. 7, the first ribs 30 being provided at intervals in the width direction intersecting the medium transportation direction. The wave-like shape is a shape formed by the mountain portions T and the valley portions V extending in the medium transportation direction (Y axis direction) and alternately positioned in the width direction (X axis direction)

In the present embodiment, the plurality of first ribs 30 are configured such that high ribs 31 forming the mountain portions T of the paper sheet P and low ribs 32 forming the valley portions V of the paper sheet P are alternately arranged in the width direction. The low ribs 32 are formed to be lower than the high ribs 31.

The pair of feeding rollers 12 (FIG. 2) that is provided on the upstream side of the medium supporting portion 16 in the medium transportation direction transports the paper sheet P such that the paper sheet P is slightly pressed against the medium supporting portion 16. The paper sheet P is transported while supported by the high ribs 31 and the low ribs 32 as the first ribs 30 from below and the cockling, which corresponds to the difference in height between the high ribs 31 and the low ribs 32, is formed on the paper sheet P.

Note that, for example, the configuration (ribs) for forming the cockling on the paper sheet also can be provided on a path forming surface that is on the upstream side of the facing area facing the recording unit 13 in the medium transportation direction instead of being provided in the medium supporting portion 16 as in the present embodiment.

Curved Path

Next, the curved path 20 will be described. As illustrated in FIG. 4, the curved path 20 is configured to be provided with an outer curved portion 20*a* and an inner curved portion 20*b*. The transported paper sheet passes through a space between the inner curved portion 20*b* and the outer curved portion 20*a*, is curved and inverted, and discharged from the discharge section 28.

The curved path 20 illustrated in FIG. 4 is provided with a plurality of second ribs 33 (refer to FIG. 11 as well) that extend in the medium transportation direction (Y axis direction) and are provided on the outer curved portion 20*a* at intervals in the width direction (X axis direction) and a plurality of third ribs 34 (refer to FIG. 11 as well) that extend in the medium transportation direction (Y axis direction) and are provided on the inner curved portion 20*b* at intervals in the width direction (X axis direction).

In FIG. 1, a second cover 27 is provided above the first cover 26. As illustrated in FIG. 11, the second cover 27 can be integrally opened with the first cover 26. Note that, the first cover 26 can be opened alone as illustrated in FIGS. 4 and 5.

When the second cover 27 is opened as illustrated in FIG. 11, the outer curved portion 20*a* and the inner curved portion 20*b* are exposed. A side of the second cover 27 that faces the casing 2 is provided with the outer curved portion 20*a* constituting the curved path 20. Meanwhile, on the casing 2 side, the inner curved portion 20*b* constituting the curved path 20 is provided. When the second cover 27 is closed with respect to the casing 2, the outer curved portion 20*a* and the inner curved portion 20*b* face each other while being separated from each other as illustrated in FIGS. 4 and 12 such that the outer curved portion 20*a* and the inner curved portion 20*b* constitute the curved path 20.

In addition, as illustrated in each of FIGS. 15A to 15C, the plurality of second ribs 33 and the plurality of third ribs 34 are disposed at positions in the width direction (X axis direction) that correspond to the mountain portions T and the valley portions V of the wave-like shape (cockling) of the paper sheet that is formed by the plurality of the first ribs 30 (high ribs 31 and low ribs 32).

More specifically, as illustrated in FIG. 10, the plurality of second ribs 33 and the plurality of third ribs 34 are provided at positions corresponding to the high ribs 31 and the low ribs 32 in the width direction, the high ribs 31 and the low ribs 32 constituting the first ribs 30.

In the present example, the plurality of second ribs 33 and the plurality of third ribs 34 are provided at the same positions as the high ribs 31 and the low ribs 32 constituting the first ribs 30 in the width direction.

In other words, the plurality of second ribs 33 and the plurality of third ribs 34 are on lines that extend from the high ribs 31 and the low ribs 32 constituting the first ribs 30 in the medium transportation direction, respectively.

In addition, in the present embodiment, intervals d between the top points of the second ribs 33 and the top points of the third ribs 34 facing the second ribs 33, which are illustrated in FIG. 12, become narrower toward the downstream side from the upstream side in the medium transportation direction. That is, the curved path 20 is configured to be tapered when the device is seen in the X axis direction as illustrated in FIG. 4.

In the present embodiment, the heights of the second ribs 33 and the third ribs 34 are constant in the medium transportation direction and the outer curved portion 20*a* and the inner curved portion 20*b* are formed such that the distance between the outer curved portion 20*a* and the inner curved portion 20*b* decreases toward the downstream side in the medium transportation direction and thus the intervals d become narrower toward the downstream side in the medium transportation direction.

FIG. 15A illustrates a section taken along line XVA-XVA in the right drawing of FIG. 13, FIG. 15B illustrates a section taken along line XVB-XVB in the right drawing of FIG. 13, and FIG. 15C illustrates a section taken along line XVC-XVC in the right drawing of FIG. 13.

As illustrated in FIGS. 15A to 15C, the widths of intervals d1, d2, and d3 descend toward the downstream side in this order: the interval d1 in the section taken along line XVA-XVA that is closest to the upstream side in the medium transportation direction, the interval d2 in the section taken along line XVB-XVB, and the interval d3 in the section taken along line XVC-XVC (interval d1>interval d2>interval d3).

As described above, since the curved path 20 is tapered, a leading end of the paper sheet P passing through the curved path 20 is more reliably nipped by the pairs of downstream side rollers 19.

Note that, for example, the configuration in which the intervals d between the top points of the second ribs 33 and the top points of the third ribs 34 facing the second ribs 33 become narrower toward the downstream side from the upstream side in the medium transportation direction can be realized by providing the outer curved portion 20*a* and the inner curved portion 20*b* to be parallel to each other over an area from the upstream side to the downstream side in the medium transportation direction and forming the second ribs 33 and the third ribs 34 to become higher toward the downstream side.

Here, with reference to FIGS. 13 and 14, transportation of the paper sheet P in the curved path 20 will be described. When the paper sheet P enters the curved path 20, the leading end of the paper sheet P comes into contact with the outer curved portion 20*a* as illustrated in the left drawing of FIG. 13. That is, a surface that is opposite to the latest recording surface of the paper sheet P comes into contact with the outer curved portion 20*a*. Then, the leading end proceeds along the outer curved portion 20*a* with the surface opposite to the latest recording surface pressed against the outer curved portion 20*a*.

When the paper sheet P is further transported and the leading end of the paper sheet P passing through the curved path 20 is nipped by the pairs of downstream side rollers 19, the paper sheet P is transported in a state where a portion of the paper sheet P close to the leading end (portion on downstream side in medium transportation direction) is closer to the inner curved portion 20*b* than when the paper sheet P has not been nipped by the pairs of downstream side rollers 19 yet.

Here, the plurality of second ribs 33 provided on the outer curved portion 20*a* and the plurality of third ribs 34 provided on the inner curved portion 20*b* are disposed at positions corresponding to both of the mountain portions T and the valley portions V of the wave-like shape of the paper sheet P that is formed by the first ribs 30. Therefore, when the leading end of the paper sheet P enters the curved path 20, the valley portions V abut onto the second ribs 33 as illustrated in FIG. 14.

At this time, since the valley portions V are pressed against the second ribs 33 due to the rigidity of the paper sheet P, the heights of the valley portions V become smaller as the paper sheet P proceeds in the curved path 20. That is, the wave-like shape gently becomes lower and the rigidity of the paper sheet P decreases as the paper sheet P proceeds in the curved path 20. Furthermore, since what the valley portions V are pressed against is not just a surface but the second ribs 33, transportation resistance is also suppressed.

Therefore, transportation resistance and damage to the paper sheet P (wrinkle, fold, or like) that are made when the paper sheet P on which the wave-like shape is formed is transported through the curved path 20 can be decreased.

For example, even when a configuration in which the wave-like shape of the paper sheet P becomes lower is provided on the upstream side of the curved path 20 in the medium transportation direction, the above-described effect (decrease in transportation resistance and damage to paper sheet) can also be achieved. However, when the plurality of the second ribs 33 and the plurality of the third ribs 34 are provided in the curved path 20, the configuration in which the wave-like shape of the paper sheet P becomes lower can be provided without an increase in path length.

In addition, since the paper sheet P is transported while the surface that is opposite to the latest recording surface is pressed against the second ribs 33 of the outer curved portion 20*a* and the wave-like shape becomes lower in this process, the latest recording surface is less likely to be damaged.

Therefore, it is possible to provide the medium transporting device 5 that has been designed in consideration of both of a decrease in transportation load and damage to the paper sheet P transported through the curved path 20 and suppression of an increase in size of the device.

In addition, since the plurality of second ribs 33 and the plurality of third ribs 34 are provided at the same positions as the high ribs 31 and the low ribs 32 constituting the first ribs 30 in the width direction, it is possible to easily realize a configuration in which the plurality of second ribs 33 and the plurality of third ribs 34 are disposed at positions corresponding to both of the mountain portions T and the valley portions V of the wave-like shape of the paper sheet P, which is formed by the plurality of first ribs 30, in the width direction.

Furthermore, when a configuration in which the intervals d (FIG. 12) between the top points of the second ribs 33 and the top points of the third ribs 34 facing the second ribs 33 become narrower toward the downstream side from the upstream side in the medium transportation direction is adopted, a configuration in which an inlet of the curved path 20 through which the paper sheet P enters the curved path 20 is wide and the medium on which the wave-like shape is formed easily enters the curved path 20 can be realized. In addition, as illustrated in FIG. 13, since the gap through which the paper sheet P is fed becomes narrower as the paper sheet P is transported, the difference in height between the mountain portion and the valley portion of the wave-like shape can be gradually decreased as illustrated in FIGS. 15A to 15C.

Note that, in the present embodiment, the curved path 20 provided with the second ribs 33 and the third ribs 34 is a path from which a paper sheet after recording is discharged with a recording surface facing a lower side. However, for example, the second ribs 33 and the third ribs 34 may also be provided in a curved path of a medium transporting device that inverts a paper sheet at the time of duplex recording.

Note that, in the present embodiment, as illustrated in FIGS. 14 to 15C, the second ribs 33 and the third ribs 34 are disposed at all of positions corresponding to both of the mountain portions T and the valley portions V as an example in which the second ribs 33 and the third ribs 34 are disposed at positions corresponding to the mountain portions T and the valley portions V of the wave-like shape of the paper sheet P. However, the invention is not limited to this. For example, the second ribs 33 may be provided only at positions corresponding to the valley portions V and the third ribs 34 may be provided only at positions corresponding to the mountain portions T. In addition, the second ribs 33 and the third ribs 34 may be appropriately made sparse instead of being disposed at all of the positions corresponding to the mountain portions T and the valley portions V.

Supporting Portion

In the present embodiment, the supporting portion 25 is also provided with ribs. As illustrated in FIGS. 9 and 10, the supporting portion 25 is provided with a plurality of fourth ribs 35 that extend in the medium transportation direction (Y axis direction) and are provided at the same intervals as the second ribs 33 in the width direction (X axis direction). In the present embodiment, the positions of the fourth ribs 35 in the X axis direction are substantially the same as the positions of the second ribs 33.

Since the supporting portion 25 that is provided on the upstream side of the curved path 20 and is close to the curved path 20 is provided with the plurality of fourth ribs 35 that are provided at the same intervals as the second ribs 33, a paper sheet on which the wave-like shape is formed can be appropriately fed to the curved path 20.

Other Configurations of Second Ribs on Outer Curved Portion and Fourth Ribs on Supporting Portion With reference to FIGS. 18 to 22, other configurations of the second ribs 33 on the outer curved portion 20*a* and the fourth ribs 35 on the supporting portion will be described. In each of FIGS. 18 to 22, the supporting portion 25 is in the first state in which the supporting portion 25 and the outer curved portion 20*a* as the curved path 20 are lined up.

Figure 18:
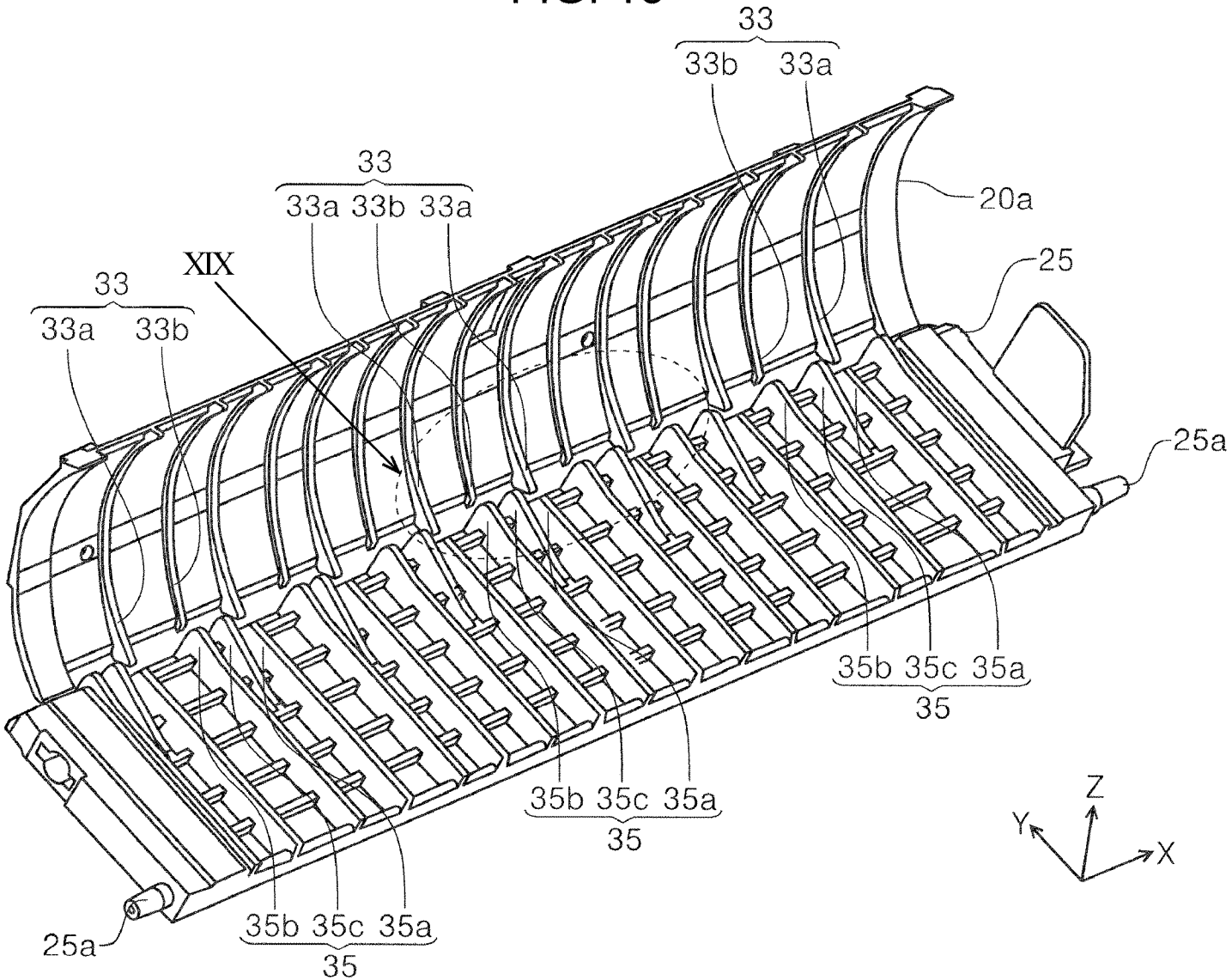
FIG. 18 is a perspective view illustrating an outer curved portion and the supporting portion in the first state.
Figure 22:
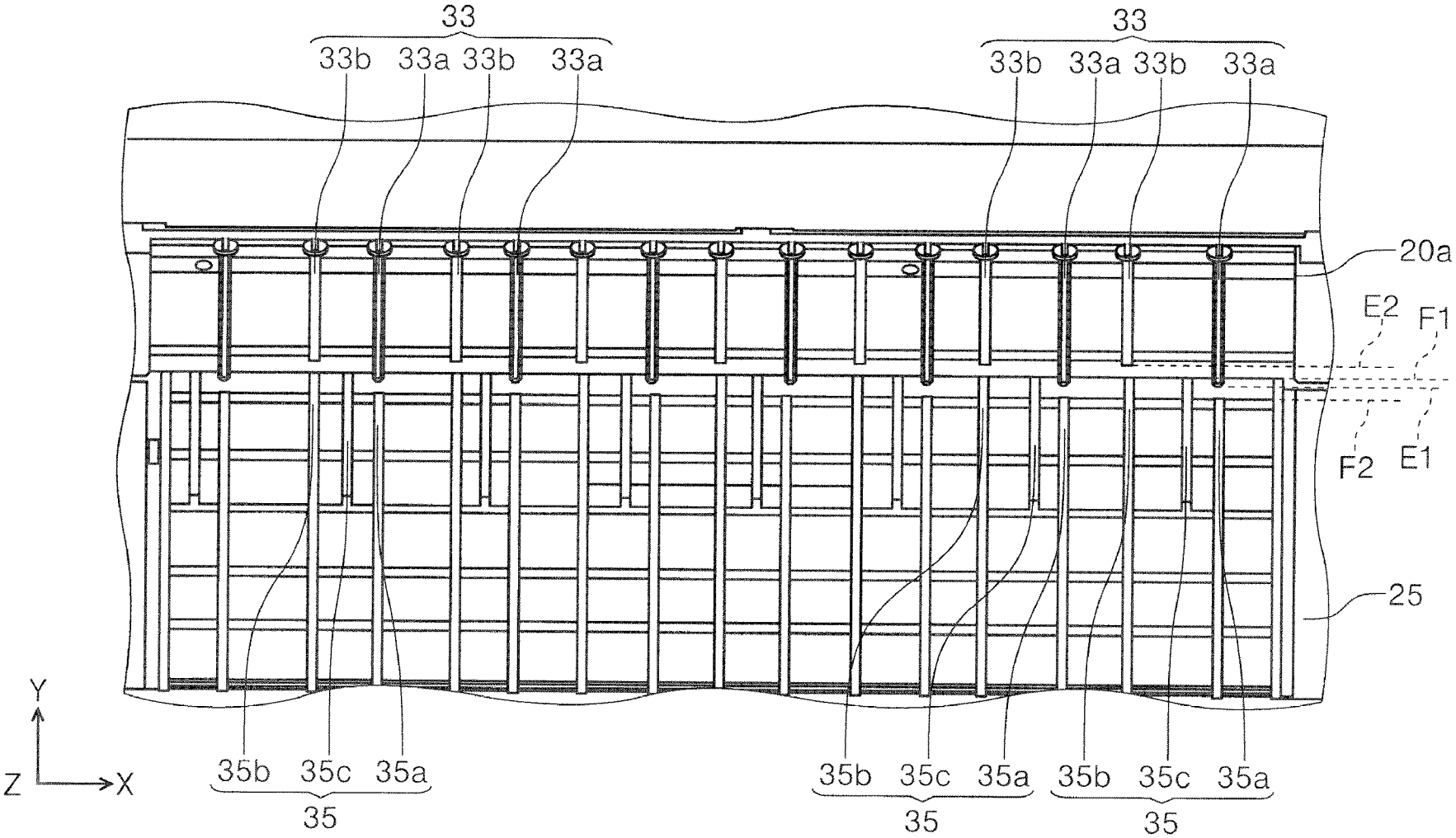
FIG. 22 is a plan view illustrating the outer curved portion and the supporting portion.

As illustrated in FIGS. 18 and 22, the plurality of second ribs 33 include upstream side second ribs 33*a* and downstream side second ribs 33*b* of which upstream side end portions in the medium transportation direction are positioned closer to the downstream side than those of the upstream side second ribs 33*a*, the upstream side second ribs 33*a* and the downstream side second ribs 33*b* being alternately arranged in the width direction (X axis direction). In FIG. 22, a position represented by a reference symbol "E1" is the position of the upstream side end portion of the upstream side second rib 33*a* and a position represented by a reference symbol "E2" is the position of the upstream side end portion of the downstream side second rib 33*b*.

In addition, as illustrated in FIGS. 18 and 22, the plurality of fourth ribs 35 include upstream side fourth ribs 35*a* that are provided at positions corresponding to the upstream side second ribs 33*a* in the width direction, downstream side fourth ribs 35*b* of which upstream side end portions in the medium transportation direction are positioned closer to the downstream side than those of the upstream side fourth ribs 35*a* and which are provided at positions corresponding to the downstream side second ribs 33*b* in the width direction, and auxiliary ribs 35*c* that are provided on at least one side in the width direction with respect to the upstream side fourth ribs 35*a*. In FIG. 22, a position represented by a reference symbol "F1" is the position of the upstream side end portion of the upstream side fourth rib 35*a* and a position represented by a reference symbol "F2" is the position of the upstream side end portion of the downstream side fourth rib 35*b*.

In the present embodiment, the auxiliary ribs 35*c* are provided on the −X side with respect to the upstream side fourth ribs 35*a*. However, the auxiliary ribs 35*c* may be provided on both sides in the width direction with respect to the upstream side fourth ribs 35*a*.

In addition, as illustrated in FIG. 22, the upstream side second ribs 33*a* are provided such that the upstream side second ribs 33*a* partially overlap both of the downstream side fourth ribs 35*b* and the auxiliary ribs 35*c* in the medium transportation direction in a case where the supporting portion 25 is in the first state.

In FIG. 22, the upstream side second ribs 33*a* and the downstream side fourth ribs 35*b* overlap each other in a space between a position E1 and a position F1 in the medium transportation direction. Similarly, the upstream side second ribs 33*a* and the auxiliary ribs 35*c* overlap each other in a space between the position E1 and the position F1 in the medium transportation direction.

According to this configuration, in a case where the supporting portion 25 is in the first state, the second ribs 33 on the outer curved portion 20*a* and the fourth ribs 35 on the supporting portion 25 mesh with each other in a shape like teeth of a comb. Therefore, the transported paper sheet P can smoothly pass through a joint between the supporting portion 25 and the outer curved portion 20*a* without being caught in the joint.

Figure 19:
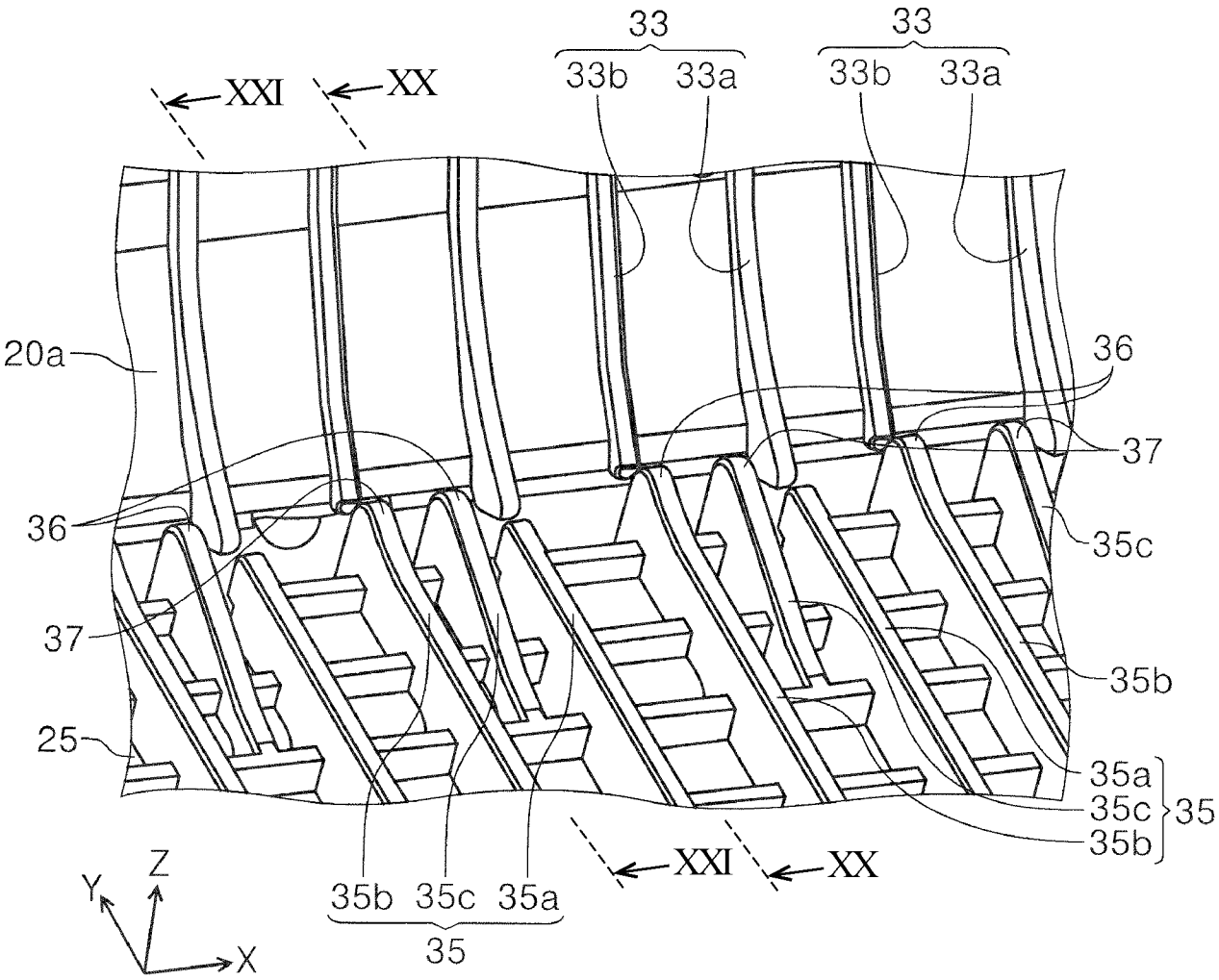
FIG. 19 is an enlarged perspective view of part XIX in FIG. 18.
Figure 20:
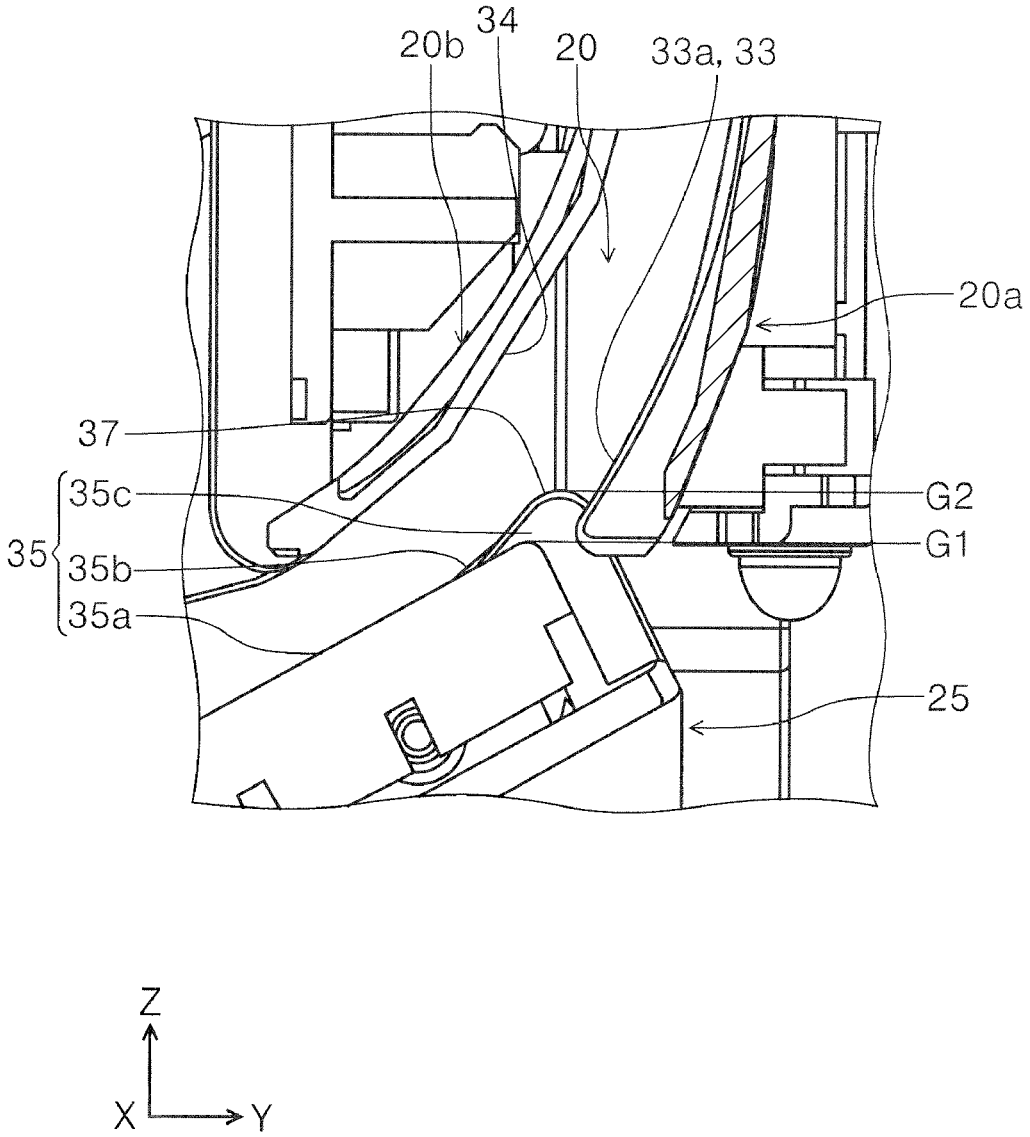
FIG. 20 is a sectional view taken along line XX-XX in FIG. 19.
Figure 21:
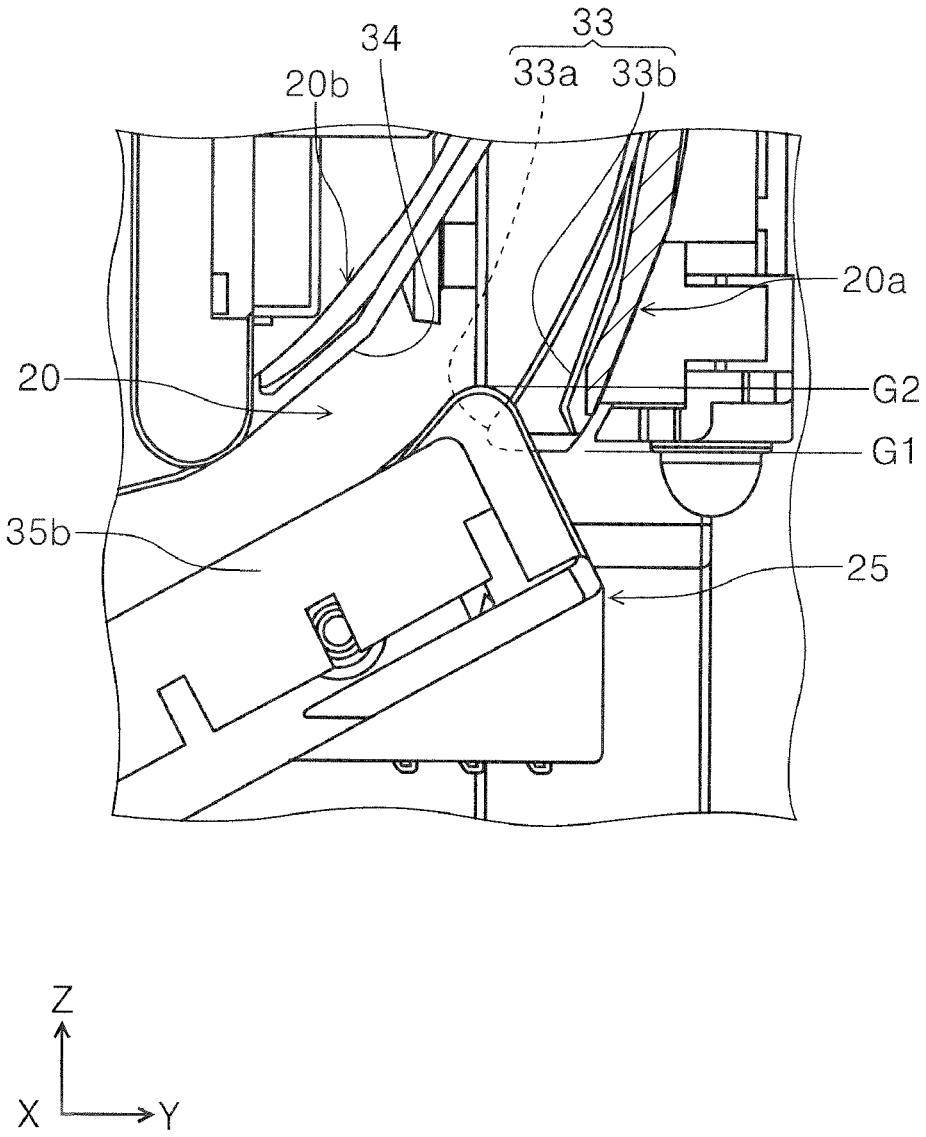
FIG. 21 is a sectional view taken along line XXI-XXI in FIG. 19.

In addition, as illustrated in FIG. 20 or FIG. 21, the downstream side fourth ribs 35*b* and the auxiliary ribs 35*c*, which are at least some of the plurality of the fourth ribs 35, are provided with protruding portions 36 and 37 that are provided on downstream side end portions of the downstream side fourth ribs 35*b* and the auxiliary ribs 35*c* in the medium transportation direction and protrude upward in a side view as seen in the width direction (X axis direction). As illustrated in FIGS. 19 and 21, a protruding portion provided for the downstream side fourth rib 35*b* is the protruding portion 36 and as illustrated in FIGS. 19 and 20, a protruding portion provided for the auxiliary rib 35*c* is the protruding portion 37.

As illustrated in FIG. 20, the height of each of the upstream side end portions of the upstream side second ribs 33*a* in the height direction and the height of each of the downstream side end portions of the upstream side fourth ribs 35*a*, which are disposed at positions corresponding to the upstream side second ribs 33*a* in the width direction, in the height direction are the same height G1 within the range of tolerance.

If the heights of all of downstream side tip ends of the plurality of fourth ribs 35 are the same as those of upstream side tip ends of the second ribs 33, the heights of the fourth ribs 35 and the second ribs 33 may be different from each other at the joint due to the tolerance of the members. In this case, when the second ribs 33, which are positioned on the downstream side in the medium transportation direction, are higher than the fourth ribs, the leading end of the transported paper sheet P may be caught on the second ribs.

Since the downstream side fourth ribs 35*b* and the auxiliary ribs 35*c*, which are some of the plurality of the fourth ribs 35, are provided with the protruding portions 36 and 37 that are provided on the downstream side end portions of the downstream side fourth ribs 35*b* and the auxiliary ribs 35*c* in the medium transportation direction and protrude upward in the side view as seen in the width direction, the positions of the downstream side end portions of the downstream side fourth ribs 35*b* and the downstream side end portions of the auxiliary ribs 35*c* in the height direction are positions represented by a reference symbol "G2", which are higher than a position represented by a reference symbol "G1", as illustrated in FIG. 20 or FIG. 21.

Accordingly, even if there is a variation between the heights of the second ribs 33 and the fourth ribs 35 due to the tolerance of the members, the downstream side fourth ribs 35*b* and the auxiliary ribs 35*c* can be reliably higher than the upstream side second ribs 33*a* and the downstream side second ribs 33*b* as the second ribs 33 at the joint. Therefore, it is possible to reduce a possibility that the leading end of the paper sheet P is caught on the second ribs 33 at the joint between the supporting portion 25 and the outer curved portion 20*a*.

Since the upstream side fourth ribs 35*a* are disposed at positions corresponding to the upstream side second ribs 33*a* in the width direction, the fourth ribs 35 cannot overlap the upstream side second ribs 33*a* in the medium transportation direction. However, since the auxiliary ribs 35*c* are provided right next to the upstream side fourth ribs 35*a*, it is possible to further effectively suppress the paper sheet P being caught.

Note that, for example, the auxiliary ribs 35*c* as the fourth ribs 35 may be omitted and a downstream side tip end of each of the upstream side fourth ribs 35*a* may be provided with a protruding portion. In addition, the auxiliary ribs 35*c* may be omitted and only the downstream side fourth ribs 35*b* may be provided with the protruding portions 36 without providing a protruding portion for the upstream side fourth ribs 35*a*.

Other Configurations of Printer

Relationship Between Number of Pairs of Upstream Side Rollers and Number of Pairs of First Rollers As illustrated in FIG. 9, the plurality of pairs of upstream side rollers 18 are provided at intervals in the width direction (X axis direction) and the plurality of pairs of first rollers 17 are provided at intervals in the width direction (X axis direction).

In the embodiment, eight pairs of first rollers 17 are provided and six pairs of upstream side rollers 18 are provided near the central portion in the width direction. That is, the number of the pairs of upstream side rollers 18 is smaller than the number of the pairs of first rollers 17.

Note that, the six pairs of upstream side rollers 18 are disposed such that the pairs of upstream side rollers 18 are disposed in an area of which the width is smaller than the width of a post card. Due to the small number of pairs of upstream side rollers 18 disposed near the central portion, a paper sheet of which the width is larger than that of a post card also can be fed to the curved path 20.

Since the number of the pairs of upstream side rollers 18 is smaller than the number of the pairs of first rollers 17, it is possible to reduce the manufacturing cost for the device.

Relationship Between Diameter of Upstream Side Serrated Roller and Diameter of First Serrated Roller In the printer 1 according to the present embodiment, the diameter of the upstream side serrated roller 18*b* constituting the pair of upstream side rollers 18 is smaller than the diameter of the first serrated roller 17*b* constituting the pair of first rollers 17 as illustrated in FIG. 8.

Therefore, it is possible to realize reduction in size of the device by effectively utilizing a space around the first serrated roller 17*b* (pair of first rollers 17).

In the present embodiment, as illustrated in FIGS. 16 and 17, a tube holding portion 61 is provided in a space that is on the upstream side (−Y direction side) of the first serrated rollers 17*b* and is close to the first serrated rollers 17*b*. The tube holding portion 61 is a component that holds the supply tube 60 through which ink is supplied to the recording unit 13 from the ink tank 29. The tube holding portion 61 holds the supply tube 60, of which one end side is connected to the recording unit 13 and the other end side is connected to the ink tank 29, such that the supply tube 60 can be deformed in accordance with a movement of the carriage 14 in the width direction (X axis direction). FIG. 16 illustrates a state where the carriage 14 is positioned at an end portion in a +X axis direction and FIG. 17 illustrates a state where the carriage 14 is positioned at an end portion in a −X axis direction.

Note that, in the present embodiment, the diameter of the downstream side serrated roller 19*b* constituting the pair of downstream side rollers 19 is the same as the diameter of the upstream side serrated roller 18*b* and is smaller than the diameter of the first serrated roller 17*b*. Therefore, it is also possible to secure a space around the pair of downstream side rollers 19 as well.

Motive Power Transmitting Mechanism

In the present embodiment, the first driving roller 17*a* constituting the pair of first rollers 17, the upstream side driving roller 18*a* constituting the pair of upstream side rollers 18, and the downstream side driving roller 19*a* constituting the pair of downstream side rollers 19 are driven by the motor 40, which is the shared drive source illustrated in FIG. 9. The drive force of the motor 40 is transmitted to the first driving roller 17*a*, the upstream side driving roller 18*a*, and the downstream side driving roller 19*a* via a motive power transmitting mechanism 41 (FIG. 9).

Hereinafter, the motive power transmitting mechanism 41 will be described with reference to FIG. 9.

A rotary shaft (not shown) of the motor 40 is provided with a first gear 43 that rotates coaxially with the rotary shaft. A reference symbol "42" represents an encoder scale 42 for detecting the rotation of the motor 40. The first gear 43 meshes with a second gear 44 and the second gear 44 meshes with a third gear 45 that is provided to be coaxial with a rotary shaft 52 for the first driving rollers 17*a*. Accordingly, a motive power from the motor 40 is transmitted to the rotary shaft 52 such that the rotary shaft 52 rotates and thus the first driving rollers 17*a* are rotated.

In addition, the third gear 45 meshes with a fourth gear 46 and the fourth gear 46 meshes with a fifth gear 47 that is provided to be coaxial with a rotary shaft 53 for the upstream side driving rollers 18*a*. Accordingly, a motive power from the motor 40 is transmitted to the rotary shaft 53 such that the rotary shaft 53 rotates and thus the upstream side driving rollers 18*a* are rotated.

Furthermore, the fifth gear 47 meshes with a sixth gear 48, the sixth gear 48 meshes with a seventh gear 49, and the seventh gear 49 meshes with an eighth gear 50. The eighth gear 50 meshes with a ninth gear 51 that is provided to be coaxial with a rotary shaft 54 for the downstream side driving rollers 19*a*. Accordingly, a motive power from the motor 40 is transmitted to the rotary shaft 54 such that the rotary shaft 54 rotates and thus the downstream side driving rollers 19*a* are rotated.

Relationship Between Transportation Speed of Pair of First Rollers and Transportation Speed of Pair of Upstream Side Rollers In the printer 1 illustrated in FIG. 2, the transportation speed of the pairs of first rollers 17 and the transportation speed of the pairs of upstream side rollers 18 are set to be the same speed each other. The transportation speed of the pairs of first rollers 17 and the transportation speed of the pairs of upstream side rollers 18 can be adjusted by controlling the motor 40 (FIG. 9) with a controller (not shown).

Since the transportation speed of the pairs of first rollers 17 and the transportation speed of the pairs of upstream side rollers 18 are the same speed each other, a paper sheet can be appropriately transported without being bent or the like between the pairs of first rollers 17 and the pairs of upstream side rollers 18.

Relationship Between Transportation Speed of Pair of Upstream Side Rollers and Transportation Speed of Pair of Downstream Side Rollers In the printer 1 illustrated in FIG. 2, the transportation speed of the pairs of downstream side rollers 19 is set to be higher than the transportation speed of the pairs of upstream side rollers 18.

Specifically, the speed of the pairs of downstream side rollers 19 is increased such that the speed increase rate of the transportation speed of the pairs of downstream side rollers 19 with respect to the transportation speed of the pairs of upstream side rollers 18 becomes 1% to 3%.

Since the transportation speed of the pairs of downstream side rollers 19 is higher than the transportation speed of the pairs of upstream side rollers 18, it is possible to reduce a possibility that a paper sheet is loosened and jammed in the curved path 20.

Here, when the transportation speed of the pairs of downstream side rollers 19 is higher than the transportation speed of the pairs of upstream side rollers 18 in a case where the paper sheet P is nipped by both of the pairs of upstream side rollers 18 and the pairs of downstream side rollers 19, the paper sheet becomes closer to the inner curved portion 20*b* side as the transportation progresses since a leading end side of the paper sheet is pulled. If the transportation speed of the pairs of downstream side rollers 19 is excessively high, there is an increase in transportation load because the paper sheet is pressed against the inner curved portion 20*b* before a following end of the paper sheet nipped by the pairs of upstream side rollers 18 is released.

Since the speed increase rate of the transportation speed of the pairs of downstream side rollers 19 with respect to the transportation speed of the pairs of upstream side rollers 18 is 1% to 3%, it is possible to reduce a possibility that the paper sheet comes into contact with the inner curved portion 20*b* of the curved path 20 and it is possible to more appropriately transport the paper sheet.

Relay Portion

As illustrated in FIG. 8, a relay portion 55 is provided between the medium supporting portion 16 and the supporting portion 25 in the medium transportation direction. The relay portion 55 is also provided with a plurality of fifth ribs 56 that extend in the medium transportation direction (Y axis direction) and are disposed at intervals in the width direction (X axis direction) (FIGS. 9 and 10).

In the present embodiment, as illustrated in FIGS. 9 and 10, some of the plurality of fifth ribs 56 is not disposed at the same positions as the first ribs 30 (high ribs 31 and low ribs 32), the second ribs 33, and the fourth ribs 35 in the width direction and is provided at a position separated from the first ribs 30, the second ribs 33, and the fourth ribs 35.

Next, with reference to FIGS. 23 to 26, a printer 1A, which is an example of the recording apparatus, will be described. The printer 1A is configured to be substantially the same as the printer 1 illustrated in FIG. 1 except for the configuration of a scanner unit 3A. The scanner unit 3A is a type of flat head scanner that is not provided with the ADF unit 4*b* as an automatic medium feeding device (auto document feeder). The scanner unit 3A is provided above the casing 2 while being supported by a right supporting member 62A and a left supporting member 62B illustrated in FIG. 25. Components in the printer 1A illustrated in FIGS. 23 to 26, which are the same components as those in the printer 1 illustrated in FIG. 1, are given the same reference symbols and description thereof will be omitted.

Positional Relationship Between Ink Bottle for Ink Supply and Scanner Unit

Figure 23:
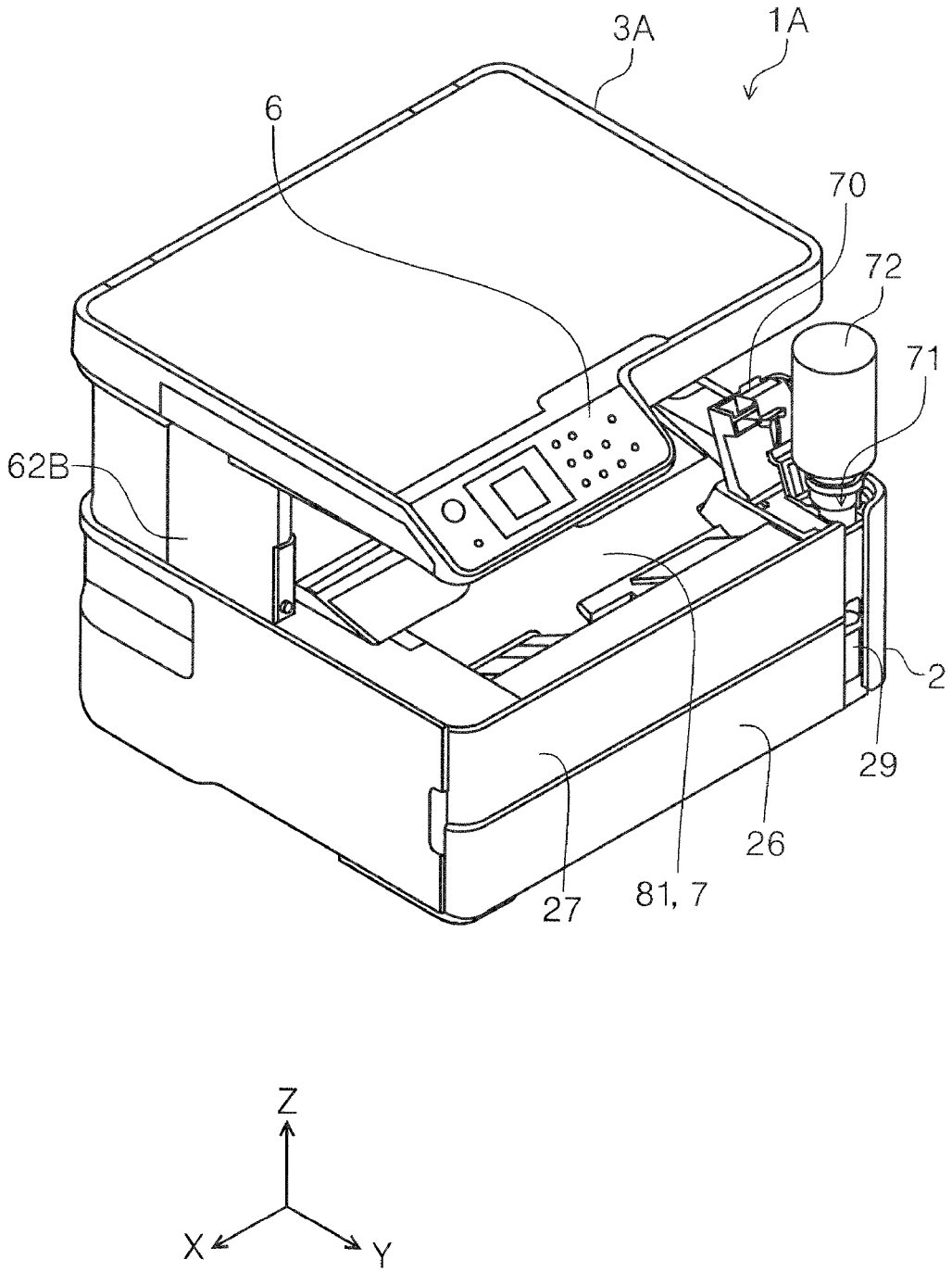
FIG. 23 is a perspective view illustrating a state where an ink bottle is inserted into an ink tank in the printer according to the first embodiment.
Figure 24:
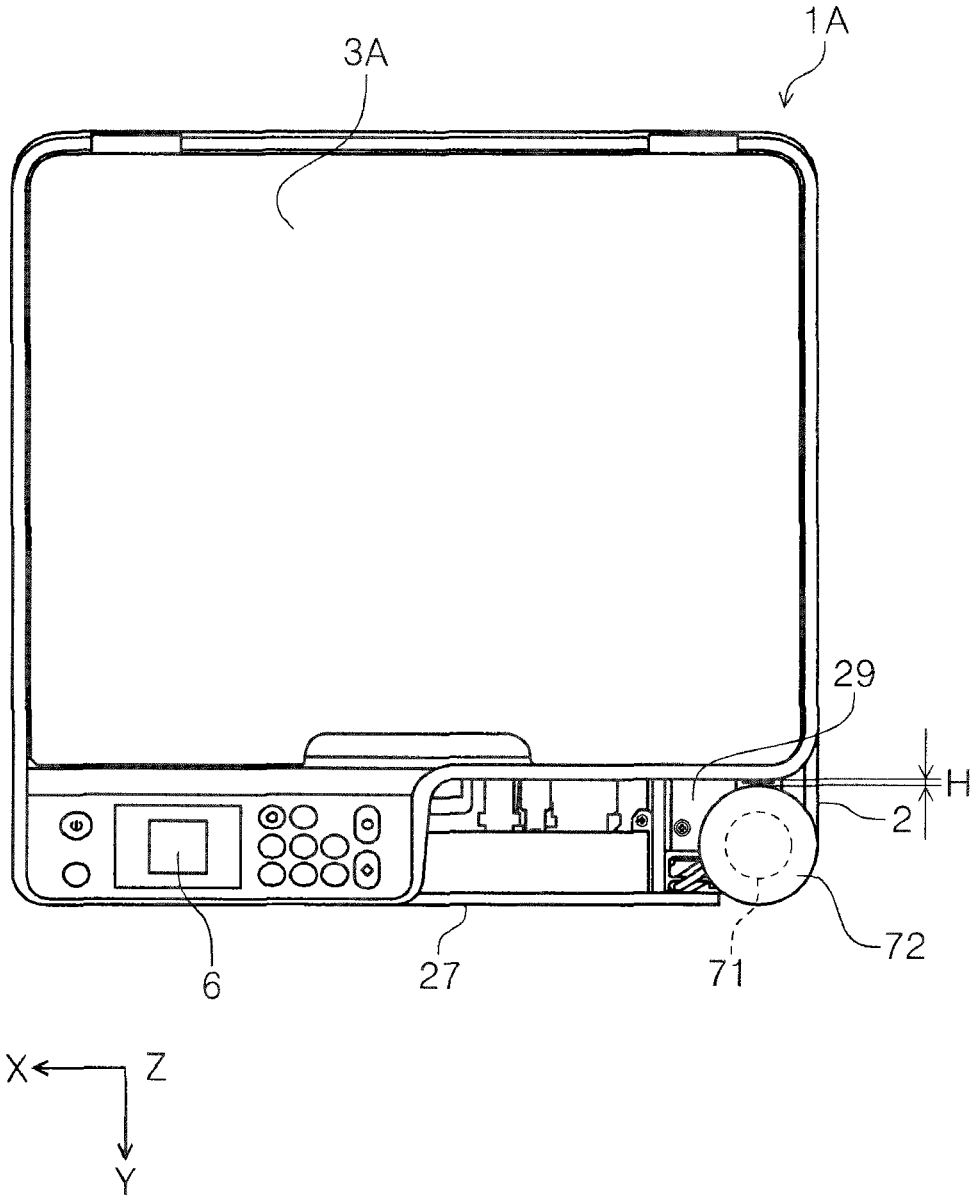
FIG. 24 is a plan view of FIG. 23.
Figure 25:
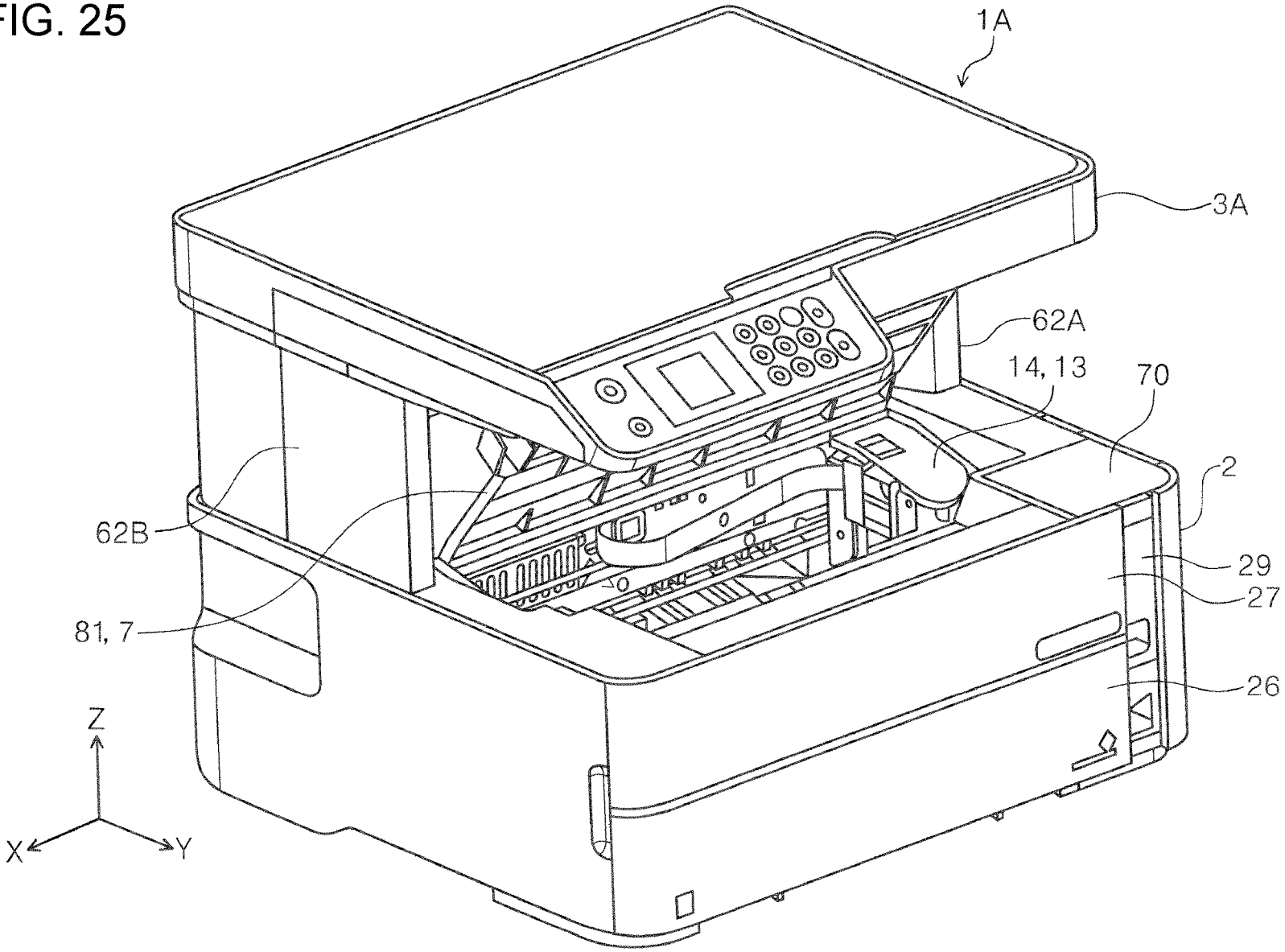
FIG. 25 is a view illustrating a state where a first discharge tray is open in the printer according to the first embodiment.

As with the printer 1 illustrated in FIG. 1, on a right side of the front surface of the casing 2, the ink tank 29 is provided. As illustrated in FIGS. 23 and 24, an upper portion of the ink tank 29 is provided with an ink supply port 71 in which an ink bottle 72 for ink supply can be installed. As illustrated in FIG. 25, the ink supply port 71 is covered by an ink tank cover 70 when ink is not supplied to the ink tank 29.

As illustrated in FIGS. 23 and 24, the ink bottle 72 is installed in the ink supply port 71 of the ink tank 29. In addition, as illustrated in FIG. 24, the scanner unit 3A is positioned such that the scanner unit 3A does not come contact with the ink bottle 72 in a case where the ink bottle 72 is installed. Specifically, a gap H is provided between the ink bottle 72 and the scanner unit 3A in a plan view such that the ink bottle 72 and the scanner unit 3A do not come into contact with each other in the Y axis direction.

In addition, in consideration of improving the installation property of the ink bottle 72 and preventing the ink bottle 72 from coming into contact with the scanner unit 3A, a +Y side surface of the casing 2, which is a front surface of the casing 2, is configured to protrude forward (+Y side) further than the scanner unit 3A on a −X side on which the ink bottle 72 is installed.

In addition, as illustrated in FIG. 24, the ink bottle 72 is configured to be installed such that the ink bottle 72 does not come out further than an outer surface of the casing 2 in any of the Y axis direction and the X axis direction.

Furthermore, as illustrated in FIG. 23, the ink bottle 72 and the scanner unit 3A are configured such that the ink bottle 72 and the scanner unit 3A do not come into contact with each other in the Z axis direction as well. According to this configuration, it is possible to reduce a possibility that a user comes into contact with the ink bottle 72 by mistake and the ink bottle 72 is removed from the ink supply port 71 while ink is being supplied to the ink tank 29.

Note that, the ink bottle 72 may be a polygonal pillar-shaped bottle having a quadrangular bottom surface, a hexagonal bottom surface, or the like or a columnar bottle having an oval bottom surface instead of a columnar bottle illustrated in FIGS. 24 and 25.

To summarize the above description, the printer 1A is configured as follows.

The printer 1A is provided with the casing 2 in which the recording unit 13 is provided, a pair of the right supporting member 62A and the left supporting member 62B provided on an upper portion of the casing 2, and the scanner unit 3A supported by the right supporting member 62A and the left supporting member 62B.

When the printer 1A is seen in a plan view, one corner portion of the casing 2 is provided with the ink tank 29 that is provided with the ink supply port 71 in an upper portion of the casing 2.

In the printer 1A, the scanner unit 3A is provided to be positioned such that the ink bottle 72 installed in the ink supply port 71 does not come into contact with the scanner unit 3A. In other words, when the printer 1A is seen in a plan view, the scanner unit 3A is provided to be positioned so as not to cover the ink bottle 72 installed in the ink supply port 71. According to this configuration, it is possible to improve the installation property of the ink bottle 72 with respect to the ink supply port 71.

First Discharge Tray

Figure 26:
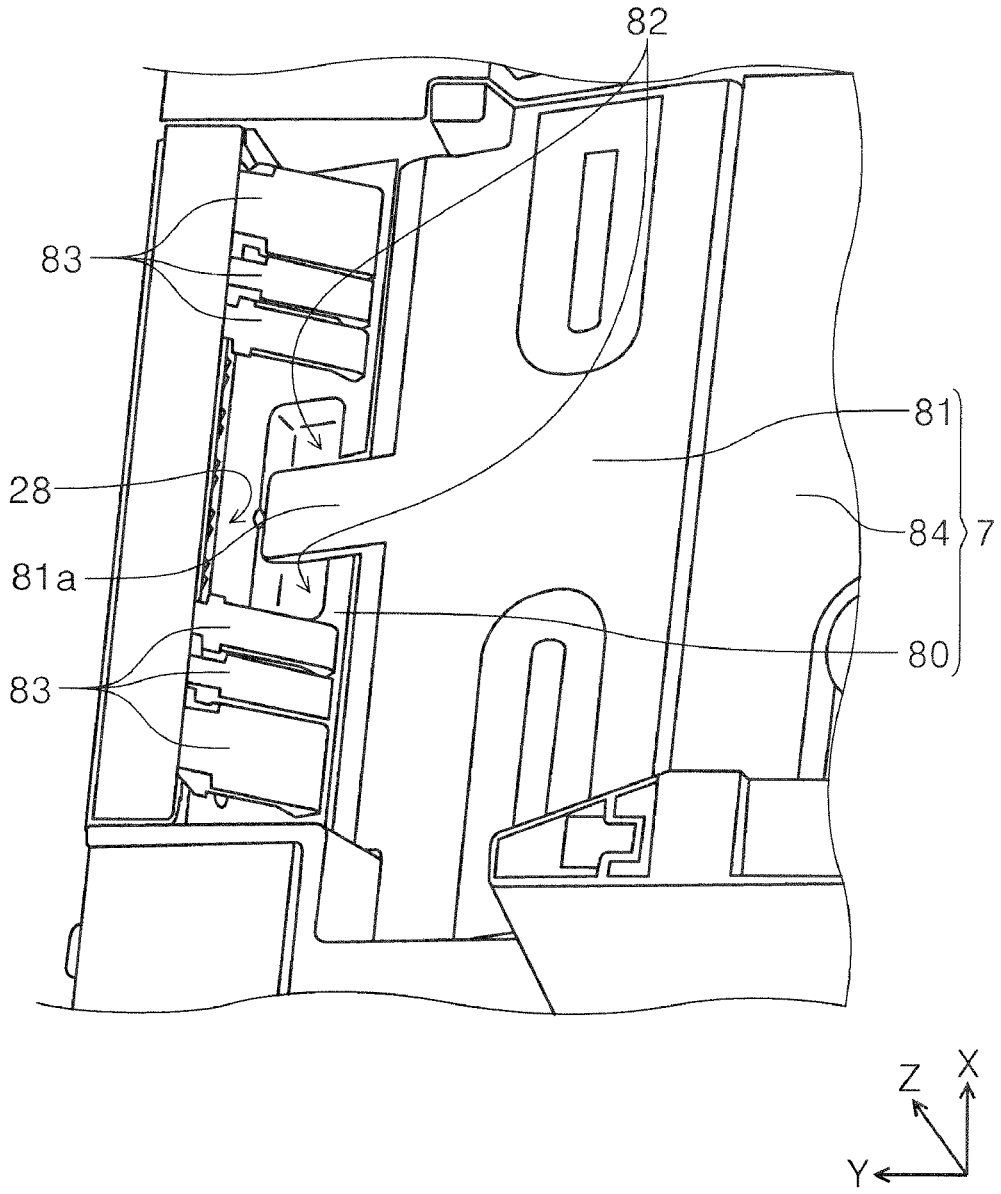
FIG. 26 is an enlarged perspective view of a main part around the first discharge tray.

In the printer 1A, the first discharge tray 7 is configured to be provided with a first receiving portion 80 that is positioned on the downstream side (−Y side) of the discharge section 28 in a medium discharge direction and is close to the discharge section 28, a second receiving portion 81 that is positioned on the downstream side of the first receiving portion 80 in the medium discharge direction, and a third receiving portion 84 that is positioned on the downstream side of the second receiving portion 81 in the medium discharge direction as illustrated in FIG. 26.

In addition, the second receiving portion 81 is provided to be rotatable with a downstream side portion thereof in the medium discharge direction as the axis of rotation and the inside of the casing 2 is exposed when the second receiving portion 81 is rotated as illustrated in FIG. 25.

FIGS. 23 and 26 illustrate a state where the second receiving portion 81 is closed and FIG. 25 illustrates a state where the second receiving portion 81 is open and the inside of the casing 2 is exposed. In addition, in FIG. 26, a reference symbol "83" corresponds to a pressing portion that presses the paper sheet P stacked on the first discharge tray 7.

As illustrated in FIG. 26, on a +Y side that is close to a free end of the second receiving portion 81, a pinched portion 81*a*, on which fingers are hooked when the second receiving portion 81 is opened, is provided. The first receiving portion 80 that overlaps the pinched portion 81*a* in the height direction (Z axis direction) in a case where the second receiving portion 81 is closed is formed with a recess portion 82 that facilitates hooking fingers on the pinched portion 81*a*. The recess portion 82 has a shape that is long in the width direction and is disposed such that the pinched portion 81*a* crosses over the vicinity of the central portion of the recess portion 82 in the width direction. Therefore, it is easy to pinch the pinched portion 81*a* with fingers interposing the pinched portion 81*a* from opposite sides in the width direction, which results in an improvement in operability.

The invention is not limited to the embodiment described above and various modifications are possible within the scope of the invention described in the claims. It is needless to say that those obtained through the various modifications are also included in the scope of the invention.

The entire disclosure of Japanese Patent Application No. 2017-210014, filed Oct. 31, 2017, and No. 2018-111237, filed Jun. 11, 2018 are expressly incorporated by reference herein.

What is claimed is:

1. An apparatus comprising:

a casing having a recording unit that is configured to record by ejecting liquid on a medium, an ink tank that is configured to supply the liquid to the recording unit and is positioned at a corner portion of the casing and a discharge tray that is configured to receive the medium discharged from the recording unit; and a scanner unit that is provided above the casing and is configured to read an image, the casing and the scanner unit forming a recessed region between the scanner unit and the casing, wherein the discharge tray is positioned at an upper portion of the casing and below the scanner unit within the recessed region, wherein the ink tank has an ink supply port on an upper portion of the ink tank, and wherein when the apparatus is seen in a plan view form a top of the apparatus, the scanner unit is positioned such that the scanner unit does not cover the ink supply port.

2. The apparatus according to the claim 1, wherein the ink supply port is configured to couple to a container portion that contains the ink for supply to the ink tank, and wherein the scanner unit is positioned such that the scanner unit does not cover the container portion when the apparatus is seen in the plan view form the top of the apparatus in a state that the container portion is coupled to the ink supply port.

3. The apparatus according to the claim 2, wherein the ink tank is positioned such that the container portion does not come out further than an outer surface of the casing when the apparatus is seen in the plan view form the top of the apparatus in a state that the container portion is coupled to the ink supply port.

4. The apparatus according to the claim 3, wherein the scanner unit is positioned such that the scanner unit does not contact the container portion in the state that the container portion is coupled to the ink supply port.

5. The apparatus according to the claim 2, wherein the scanner unit is positioned such that the scanner unit does not contact the container portion in the state that the container portion is coupled to the ink supply port.

6. The apparatus according to the claim 1, wherein the ink supply port is configured to couple to a container portion that contains the ink for supply to the ink tank, and wherein the ink tank is positioned such that the container portion does not come out further than an outer surface of the casing when the apparatus is seen in the plan view form the top of the apparatus in a state that the container portion is coupled to the ink supply port.

7. The apparatus according to the claim 6, wherein the scanner unit is positioned such that the scanner unit does not contact the container portion in the state that the container portion is coupled to the ink supply port.

8. The apparatus according to the claim 1, wherein the ink supply port is configured to couple to a container portion that contains the ink for supply to the ink tank, and wherein the scanner unit is positioned such that the scanner unit does not contact the container portion in a state that the container portion is coupled to the ink supply port.

9. An apparatus comprising:

a casing having a recording unit that is configured to record by ejecting liquid on a medium, an ink tank that is configured to supply the liquid to the recording unit and is provided on a corner portion of the casing and a discharge tray that is configured to receive the medium discharged from the recording unit; and a scanner unit that is provided above the casing and is configured to read an image, the casing and the scanner unit forming a recessed region between the scanner unit and the casing, wherein the discharge tray is positioned at an upper portion of the casing and below the scanner unit within the recessed region, wherein the ink tank has an ink supply port on an upper portion of the ink tank, wherein a scanner unit has an operation unit that is to operate a recording operation and an image reading operation, and wherein the operation unit is positioned such that the operation unit does not cover the ink tank when the apparatus is seen in a plan view form a top of the apparatus.

10. The apparatus according to the claim 9, wherein the operation unit and the ink tank are aligned in a width direction of the apparatus when the apparatus is seen in the plan view form the top of the apparatus.

11. The apparatus according to the claim 10, wherein the operation unit has a display panel, and wherein the display panel and the ink tank are aligned in the width direction of the apparatus when the apparatus is seen in the plan view form the top of the apparatus.

12. The apparatus according to the claim 11, wherein the ink supply port is configured to couple to a container portion that contains the ink for supply to the ink tank, and wherein the operation unit and the container portion are aligned in the width direction of the apparatus when the apparatus is seen in the plan view form the top of the apparatus in a state that the container portion couples to the ink supply port.

13. The apparatus according to the claim 10, wherein the ink supply port is configured to couple to a container portion that contains the ink for supply to the ink tank, and wherein the operation unit and the container portion are aligned in the width direction of the apparatus when the apparatus is seen in the plan view form the top of the apparatus in a state that the container portion couples to the ink supply port.

14. The apparatus according to the claim 9, wherein the operation unit and the ink supply port are aligned in a width direction of the apparatus when the apparatus is seen in the plan view form the top of the apparatus.

15. The apparatus according to the claim 14, wherein the operation unit has a display panel, and wherein the display panel and the ink supply port are aligned in the width direction of the apparatus when the apparatus is seen in the plan view form the top of the apparatus.

16. The apparatus according to the claim 15, wherein the ink supply port is configured to couple to a container portion that contains the ink for supply to the ink tank, and wherein the operation unit aligned with the container portion in the width direction of the apparatus when the apparatus is seen in the plan view form the top of the apparatus in a state that the container portion couples to the ink supply port.

17. The apparatus according to the claim 14, wherein the ink supply port is configured to couple to a container portion that contains the ink for supply to the ink tank, and wherein the operation unit and the container portion are aligned in the width direction of the apparatus when the apparatus is seen in the plan view form the top of the apparatus in a state that the container portion couples to the ink supply port.

18. The apparatus according to the claim 9, wherein the ink supply port is configured to couple to a container portion that contains the ink for supply to the ink tank, and wherein the operation unit and the container portion are aligned in a width direction of the apparatus when the apparatus is seen in the plan view form the top of the apparatus in a state that the container portion couples to the ink supply port.

* * * * *